US006788180B2

(12) United States Patent
Haugs et al.

(10) Patent No.: US 6,788,180 B2
(45) Date of Patent: Sep. 7, 2004

(54) CONTROLLABLE TRANSFORMER

(75) Inventors: Espen Haugs, Sperrebotn (NO); Frank Strand, Moss (NO)

(73) Assignee: Magtech AS, Moss (NO)

( * ) Notice: Subject to any disclaimer, the term of this patent is extended or adjusted under 35 U.S.C. 154(b) by 0 days.

(21) Appl. No.: 10/300,752

(22) Filed: Nov. 21, 2002

(65) Prior Publication Data

US 2003/0117251 A1 Jun. 26, 2003

Related U.S. Application Data

(60) Provisional application No. 60/633,136, filed on Nov. 27, 2001.

(30) Foreign Application Priority Data

Nov. 21, 2001 (NO) ..... 015689

(51) Int. Cl.[7] ..... H01F 27/34
(52) U.S. Cl. ..... 336/180; 336/180; 336/182
(58) Field of Search ..... 336/212, 188, 336/170, 180–182, 90, 92, 83, 60, 59

(56) References Cited

U.S. PATENT DOCUMENTS

| | | | | |
|---|---|---|---|---|
| 2,284,406 A | * | 5/1942 | D'Entremont | |
| 3,757,201 A | | 9/1973 | Cornwell | |
| 4,002,999 A | * | 1/1977 | Hesler et al. | 331/113 A |
| 4,004,251 A | * | 1/1977 | Hesler et al. | 331/113 A |
| 4,163,189 A | | 7/1979 | Smutny | 323/6 |
| 4,202,031 A | * | 5/1980 | Hesler et al. | 363/97 |
| 4,210,859 A | | 7/1980 | Meretsky et al. | 323/44 R |
| 5,936,503 A | * | 8/1999 | Holmgren et al. | 336/60 |
| 6,232,865 B1 | * | 5/2001 | Zinders et al. | 336/212 |

FOREIGN PATENT DOCUMENTS

| | | |
|---|---|---|
| NO | 146219 | 5/1982 |
| NO | 20002652 | 5/2000 |
| WO | WO 94/11891 | 5/1994 |
| WO | WO 97/34210 | 9/1997 |
| WO | WO 98/31024 | 7/1998 |
| WO | WO 01/90835 A1 | 11/2001 |

OTHER PUBLICATIONS

International Search Report for PCT/NO 02/00434, Mar. 4, 2003; 4 pages.
Copy of Norwegian Search Report 2001 5689, Jul. 10, 2002.
Copy of International Search Report PCT/NO 02/00435, mailing date Mar. 6, 2003.
Copy of International Preliminary Examination Report PCT/NO 02/00435, Mar. 16, 2004.

* cited by examiner

*Primary Examiner*—Anh Mai
(74) *Attorney, Agent, or Firm*—Testa, Hurwitz & Thibeault, LLP

(57) ABSTRACT

A controllable transformer device comprising a body of a magnetic material, a primary winding wound round the body about a first axis, a secondary winding wound round the body about a second axis at right angles to the first axis, and a control winding wound the body about a third axis, coincident with the second axis. The device can be employed to provide a frequency controlled power supply.

10 Claims, 38 Drawing Sheets

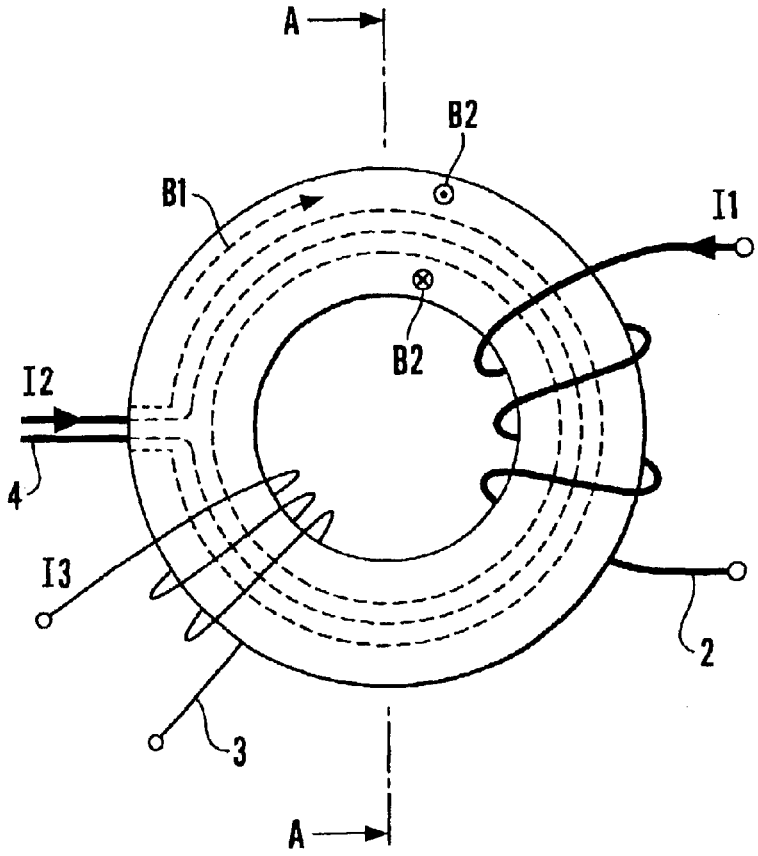
Fig.2a
Fig.2b
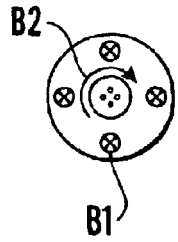
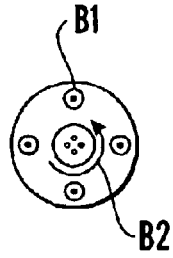
Fig.2c $I_0 = I_{fe} + I_m$ $I_m$ : MAGNETISATION CURRENT $I_{fe}$ : CORE LOSS CURRENT

CONTROLLABLE TRANSFORMER

CROSS-REFERENCE TO RELATED APPLICATIONS

This application claims priority to U.S. Provisional Application No. 60/633,136, filed Nov. 27, 2001, and to Norwegian Application No. 20015689, filed Nov. 21, 2001. The contents of each of these applications are incorporated herein by reference.

FIELD OF THE INVENTION

The present invention relates to controllable inductive devices. More particularly, the invention relates to controllable transformers.

BACKGROUND OF THE INVENTION

A transformer comprising orthogonal windings is previously known from U.S. Pat. No. 4,210,859, to Meretsky et al. of Apr. 18, 1978 (hereinafter "Meretsky"). However, the known solution manifests several disadvantages. Some of these disadvantages are described below.

In general, the problem with the prior art as illustrated by Meretsky is that it does not present a complete picture of how the manipulation of the domains with a DC control current affects the magnetisation in relation to the connection between two orthogonal windings. In Meretsky, a device is described which is developed on the basis of a test conducted on a ferrite pot core with dimensions 18×11 mm, and with current levels in the mA range. Ferrite, however, is not suitable for use at high power levels, for example, because of the high material costs associated with it. The high costs limit the size of a ferrite core from the production engineering point of view. Further, higher power levels can be transferred by increasing the frequency of the voltage that has to be converted, but this requires complicated and expensive power electronics.

Meretsky illustrates a connection diagram for a variable transformer solution with 4 windings: a primary main winding, a secondary main winding arranged at a right angle to the primary winding, and two control windings, one for each main winding. The mode of operation is such that a variable DC current in both control windings will result in a transfer of AC voltage from the primary winding to the secondary winding. A transformer of this kind cannot be considered a realistic option, particularly if it is to be applied outside the mA range, because a DC current in the control windings will rotate the domains in the magnetic material in an unfavourable direction for connection in one half cycle of the primary voltage. These domain rotations cause harmonics in the secondary voltage. This phenomenon, is not taken into consideration in Meretsky.

In order to be able to implement a realistic solution for a variable power transformer, the problem arises that the control winding on the primary side is transformatively connected to the primary winding and will be under voltage from the primary side, thereby making it very difficult to regulate without extensive filtering.

Meretsky also discloses a transformer connection (FIG. 18) where windings with right-angled axes are interconnected in series two by two. The publication states that the core's utilisation can be increased by using such a connection. This is not correct, however, since the magnetic fields for the windings are summed vectorially and the described effect will not be achieved.

Meretsky also describes (FIG. 20) a variable delay between the input and output voltage in a case where the control windings each carry current and are interconnected in series. Phase distortion is involved here since the fields through the primary and the secondary winding are shifted via the domain directions. With the control windings connected in this manner, the device will not work for a power transformer used as a phase inverter, since the connection from the primary winding will influence the control current to such an extent that in principle the same connection as mentioned earlier (FIG. 18) will be obtained.

SUMMARY OF THE INVENTION

The present invention addresses the shortcomings of the prior art by implementing a transformer in which the domain rotation is controlled.

In one aspect of the invention, a magnetisation in a transformer core provides a connection from a primary side to a secondary side by means of a current in a control winding. As a result of the orientation of a primary winding, a secondary winding and the control winding, two magnetisation currents, which are orthogonal, are summed in such a manner that the domain direction is changed linearly in a direction that is at an angle to the secondary winding. Further, an induced voltage in the secondary winding will be dependent on the size of this angle.

In one embodiment, the magnetisation of the transformer is controlled by means of a pulsed DC or a pulsed AC control current in the control winding which is located orthogonal to the primary control winding. The direction of the domains can be held constant as a result of the controlled magnetisation. The domain control also can be used to avoid a simultaneous change of the domain direction and the field strength of magnetisation. In a version of this embodiment, a constant domain direction is achieved by means of accurate dosing of the control current in relation to the primary winding's magnetisation current and the ampere-turn balance with the secondary winding.

In a further embodiment of the invention, a core plate is used which has special properties with regard to permeability. In a version of this embodiment, a laminar material is used where the magnetisation curve is the same for all directions in the plate. This involves the use of non-directional plate. However, in yet another embodiment of the invention, a directionally oriented plate is used.

The invention can also be implemented in a variable transformer/frequency converter device comprising a body of a magnetic material, a primary winding (or first main winding) wound round the body about a first axis, a secondary winding (or third main winding) wound round the body about a second axis at right angles to the first axis, and a control winding (or second main winding) wound around the body about a third axis, coincident with the second axis.

In another aspect, the invention concerns a method for controllable conversion of a primary alternating electrical signal to a secondary alternating electrical signal by the use of a device comprising a body of a magnetic material, a primary winding (or first main winding) wound round the body about a first axis, a secondary winding (or third main winding) wound round the body about a second axis at right angles to the first axis, and a control Winding (or second main winding) wound around the body about a third axis, coincident with the second axis. In one embodiment, the primary winding is supplied with a primary alternating electrical signal, the control winding is supplied with an alternating voltage which is either in phase or shifted by 180° relative to the primary alternating electrical signal, and the control winding is supplied with a variable current. As a result the transformer's conversion ratio is controlled by means of the variable current.

In a further embodiment, an amplitude adjustment of the alternating voltage changes at least one of domain directions in the magnetic material and a magnetisation angle between the primary winding and the secondary winding. An inductance is introduced in the control circuit, an electromagnetic force from the secondary winding is added to an electromagnetic force from the control winding, and a phase angle rotation between the primary winding and the secondary winding is compensated. This embodiment results in a change in the voltage transfer of the transformer and a phase angle rotation that varies according to load conditions. Additionally, the magnetisation angle between the primary winding and the secondary winding is influenced by the added electromagnetic force. Also, the effect of a direct transformative connection between the secondary winding and the control winding is suppressed. A resulting controlled transformation effect is achieved by obtaining a primary winding response to a load change in a secondary load.

In still another embodiment, the transformer device includes a hollow magnetisable core with an internal winding compartment for internal windings and an external winding compartment for external windings. In a version of this embodiment, the transformer device includes three windings: a primary winding located in the external winding compartment; an associated control winding located in the internal winding compartment; and a secondary winding located in the internal winding compartment. The windings in the external winding compartment and the windings in the internal winding compartment are aligned at right angles (perpendicular) to each other. As a result, orthogonal magnetic fields are created. Alternatively, in yet another embodiment, the internal winding compartment may house both the primary winding and the external winding compartment may house the secondary winding and the control winding. The transformer device can be used in a frequency converter. In a version of this embodiment, the frequency converter is used in the MVA range.

According to an embodiment of the invention, a magnetisation current is established in the control winding that conforms to the magnetisation current from the primary winding in amplitude in order to enable a transformative connection to be established between the primary and secondary winding that does not produce undesirable frequencies in the secondary voltage. Without this magnetisation, the desired transformative connection to the secondary winding will not result. However, there will be some degree of connection on account of the winding's extension in the compartment which provides one induced component. Another induced component will result from nonlinearities in the material.

A control voltage, in a method according to an embodiment the invention, is in phase or antiphase with the primary voltage in order to achieve a distortion-free transformative connection. Through a slow change in the amplitude of the control voltage, the direction of the domain change or the magnetisation angle between the primary winding and secondary winding can be changed. The change allows the voltage transfer to be controlled. Through introduction of an inductance in the control circuit it is possible to suppress the effect of the direct transformative connection between the secondary winding and the control winding. The secondary winding will act as a control winding, with its electromotive force (mmf) being added to electromotive force (mmf) from the control winding to influence the magnetisation angle between the primary winding and the secondary winding. Basically, it is not possible to isolate this effect from the secondary winding and we shall obtain a variable phase angle rotation between primary and secondary according to the load conditions. However, we can compensate for this by using a phase compensation device as described in PCT/NO01/00217 to compensate for the phase angle rotation. Because the primary winding will immediately respond to any load change from the secondary side, according to Lenz's law we shall achieve the desired regulating transformer effect.

The transformer according to one embodiment of the invention, includes only one control winding located in the winding compartment together with the secondary winding. In principle, a control winding in the primary winding compartment is not necessary because the primary winding will rotate the domains in its direction and also rotate any domains established from a current in the secondary winding in the same direction. In order to obtain transformative connection between the orthogonal windings, the domains must be rotated as mentioned above in order to efficiently produce a magnetisation that is in a favourable direction for transformative connection between the primary and the secondary winding. The rotation may also be described as "twisting" the secondary winding relative to the primary winding so that some of the field from the primary winding passes through the secondary winding.

In order to achieve transformer effect without distortion of the primary voltage, according to an embodiment of the invention, an (AC) alternating voltage is used on the control winding, which as previously mentioned is located in the same winding compartment as the secondary winding. When current begins to flow in the control winding, this current will reinforce the connection with the primary side because the field from the secondary current and the field from the control current help rotate the domains in the correct direction.

In another embodiment, the control voltage in the transformer will be in phase with or phase shifted 180 degrees relative to the voltage on the primary side in order to obtain a distortion-free transformation. The current in the control winding can be regulated by a system that monitors the primary and the secondary current and/or voltage as well as the control current, thus enabling the transformative connection and allowing the electrical angle between the windings to be controlled by means of the alignment of the domains. As mentioned before, the values of current and voltage in each of the primary winding, the secondary winding, and the control winding will give a clear indication of the state of the domains (rotation and magnetisation). Thus, these parameters together with reference values can be used for controlling the transformer's operation and response to different operation conditions.

In one embodiment, domains of a magnetisable core of a transformer according to an embodiment of the invention are aligned by energizing the first winding, monitoring a current in the first winding, monitoring a current in the second winding, and exciting the third winding to compensate for domain changes established by the second winding.

In another embodiment, a method of controlling the orientation of a field in a transformer includes generating a primary field in a first direction, generating a secondary field in second direction orthogonal to the first direction, generating a control field in a third direction which is coincident to the first direction, and adjusting the control field to control a direction of the primary field.

The transformer, according to an embodiment of the invention, may also advantageously be employed as a controlled rectifier or frequency converter. In order to achieve such a controlled rectifier effect from this transformer, at least two methods may be employed.

For example, in one method according to an embodiment of the invention, the primary winding of a first controllable transformer to is connected to a power supply. A central point of the secondary winding of the first transformer is connected to a load. The ends of the first secondary winding are connected to a first diode rectifier topology. An AC voltage is supplied to the first control winding in the first transformer. The primary winding of a second controllable transformer is connected to a power supply. A central point of the secondary winding of the second transformer is connected to the load in parallel with the central point of the first secondary winding. The ends of the secondary winding of the second transformer are connected to a second diode rectifier topology, and an AC voltage is supplied to the second control winding in the second transformer. In one version of this embodiment, a frequency converter for motor control is provided.

In yet another method according to an embodiment of the invention, a frequency controlled output is provided to a load. According to this embodiment, during a first period, a primary winding of a first transformer is energized, a primary winding of a second transformer is energized, a control winding of the first transformer is energized, the second transformer is maintained in an off state, and a rectified output of a secondary winding of the first transformer is supplied to the load. During a second period, the control winding of the first transformer is de-energized, a control winding of the second transformer is energized, and the rectified output of a secondary winding of the second transformer is supplied to the load. Further, during the first period the rectified output of the first transformer is a positive voltage, during the second period the rectified output of the second transformer is negative voltage, and the frequency controlled output is varied by controlling a length of the first period and a length of the second period.

In still another method according to an embodiment of the invention, rectifying is implemented by supplying an alternating voltage from a power supply to a first transformer and a second transformer, a secondary winding of the first transformer is connected to a load, and a secondary winding of the second transformer is connected to the load in parallel with the secondary winding of the first transformer. Further, at a first zero crossing of the alternating voltage, a first pulsed control voltage is supplied to a control winding of the first transformer where the first pulsed control voltage includes a signal that is both in-phase and of opposite polarity relative to the alternating voltage. At a second zero crossing of the alternating voltage, a second pulsed control voltage is supplied to a control winding of the second transformer where the second pulsed control voltage includes a signal that is both in phase and of an opposite polarity relative to the alternating voltage. Additionally, the first transformer has a primary winding connection comprising a first end, the second transformer has a primary winding connection comprising a second end, and the first end and the second end are connected to a common terminal of the power supply.

The invention is a further development of the device set forth in PCT/NO01/00217, the entire contents of which are incorporated herein by reference. However, the invention relates to a new device, since the primary and the secondary windings do not have parallel, but right-angled winding axes, and a control of the domain state is included in the present invention.

The invention will now be described in detail with reference to the drawings.

BRIEF DESCRIPTION OF THE DRAWINGS

FIGS. 1 and 2 illustrate the basic principle of the invention and a first embodiment thereof.

FIGS. 44 and 45 illustrate a section along lines VI—VI and V—V in FIG. 42.

DETAILED DESCRIPTION

The invention will now be explained in principle in connection with FIGS. 1*a* and 1*b*. In this description, the expressions "primary winding" and "secondary winding" are used to designate a winding where energy is input (i.e., the primary) and a winding which is meant for connection to a load (i.e., the secondary) as is usual in transformers. The expression "control winding" denotes a winding which controls the transformer's transformation ratio. In the device according to an embodiment the invention, the primary and the secondary windings are wound round orthogonal axes.

In the entire description, the arrows associated with magnetic field and flux will substantially indicate the directions thereof within the magnetic material. The arrows are depicted on the outside for the sake of clarity.

Figure 1A:
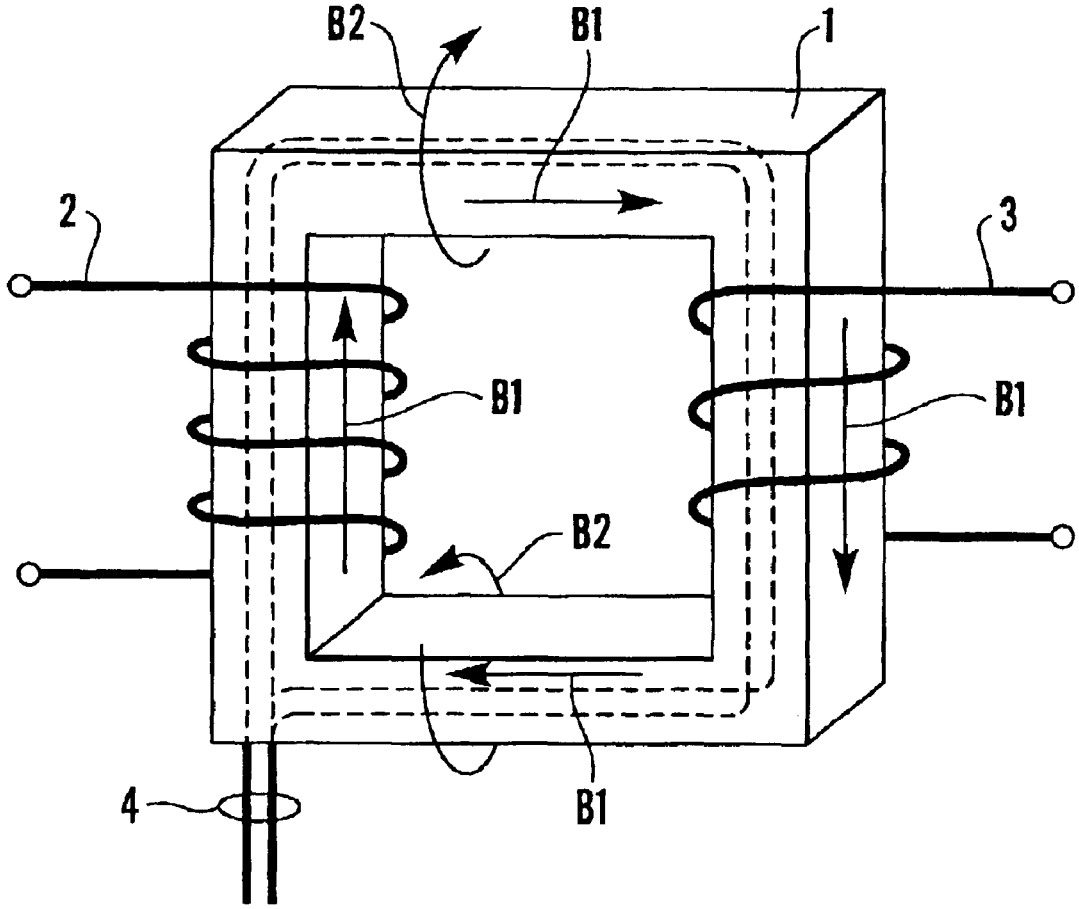
Figure 1B:
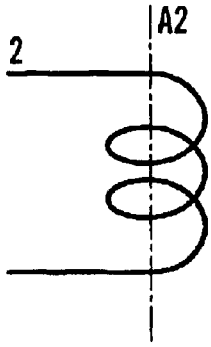
Figure 1C:
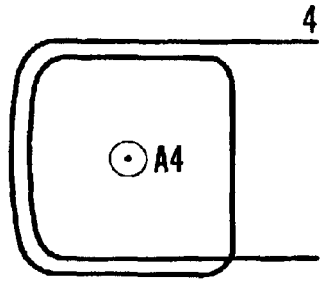
Figure 1D:
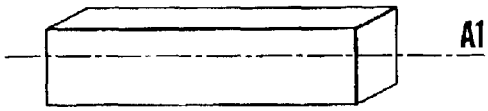
Figure 1E:
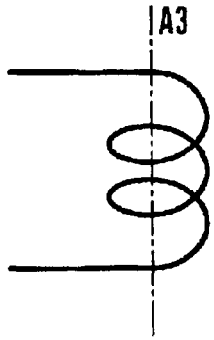
Figure 1F:
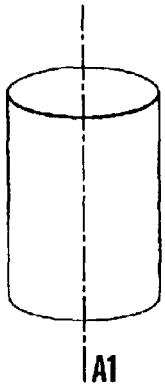
Figure 1G:
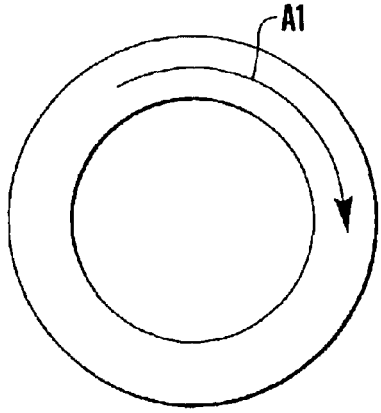
Figure 3A:
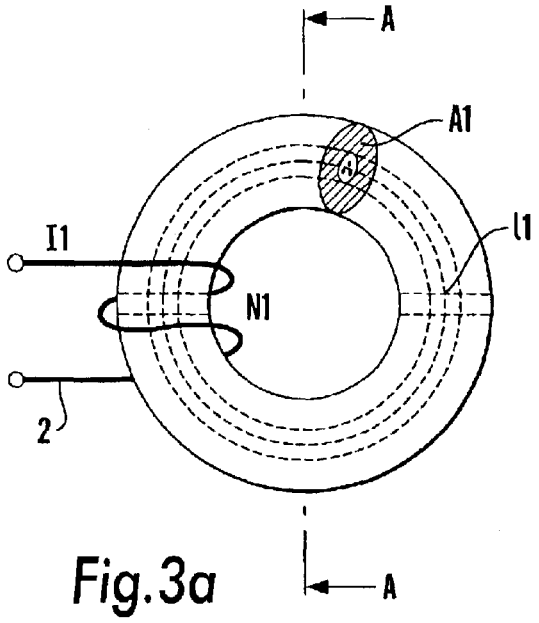
FIG. 3 illustrates the areas of the different magnetic fluxes involved in the device according to the invention.
Figure 3B:
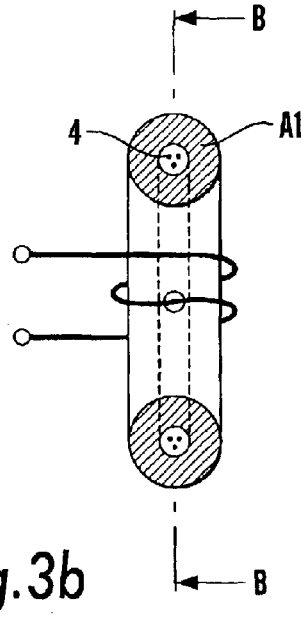
Figure 3C:
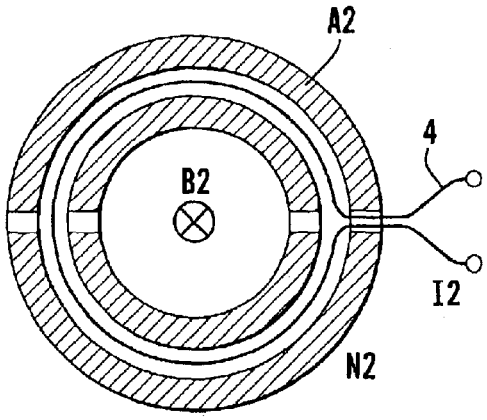
Figure 3D:
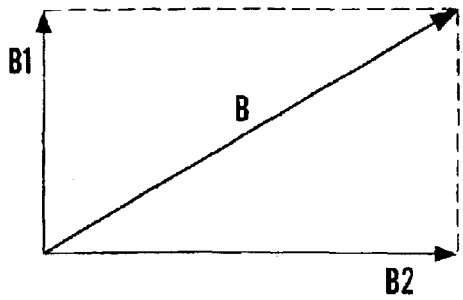

FIG. 1*a* illustrates a device comprising a body 1 of a magnetisable material that forms a closed magnetic circuit. This magnetisable body or core 1 may be annular in form or of another suitable shape. Around the body 1 is wound a first main winding 2, where the direction of the magnetic field H1 (corresponding to the direction of the flux density B1) that will be produced when the main winding 2 is excited will conform to the magnetic circuit. The main winding 2 resembles a winding in an ordinary transformer. In an embodiment the device comprises a second main winding 3, which is wound round the magnetisable body 1 in the same way as the main winding 2 and which will thereby provide a magnetic field extending substantially along the body 1 (i.e. parallel to H1, B1). Finally, the device comprises a third main winding 4, which in a preferred embodiment of the invention extends internally along the magnetic body 1. The magnetic field H2 (and thereby the flux density B2) that is created when the third main winding 4 is excited, will have a direction that is at right angles to the direction of the fields in the first and the second main winding (direction of H1, B1). According to an embodiment of the invention, the third main winding 4 constitutes a primary winding, the first main winding 2 constitutes the secondary winding and the second main winding 3 constitutes the control winding. In one embodiment, however, the turns in the main winding follow the field direction from the control field and the turns in the control winding follow the field direction of the working field.

FIGS. 1*b*–1*g* illustrate the definition of the axes and the direction of the various windings and the magnetic body. As far as the windings are concerned, we shall call the axis the direction normal to the surface defined by each turn. The secondary winding 2 will have an axis A2, the control winding 3 an axis A3 and the primary winding 4 an axis A4.

With regard to the magnetisable body 1, the longitudinal direction will vary according to the shape. If the body is elongated, the longitudinal direction A1 will coincide with the body's longitudinal axis. If the magnetic body is square as illustrated in FIG. 1*a*, it will be possible to define a longitudinal direction A1 for each leg of the square. Where the body is tubular, the longitudinal direction A1 will be the tube's axis, and for an annular body the longitudinal direction A1 will follow the circumference of the ring.

The invention employs the principle of aligning the domains in the core in the magnetisable body 1 in relation to a first magnetic field H2 by changing a second magnetic field H1 that is at right angles to the first. Thus, the field H2 may, for example, be defined as the working field and control the body's 1 domain direction (and thereby the behaviour of the working field H2) by means of the field H1 (hereinafter called control field H1). This will now be explained in greater detail.

The magnetisation in the core is directionally determined by the sources of the field that influence the domains in the material. Normally the winding compartment, i.e. the part of the core that contains the windings, is common to primary and secondary winding, with the result that domain direction and magnetisation are also common. In a preferred embodiment of the invention, the winding compartments are orthogonal with the result that the fields from the two windings are orthogonal and consequently there is no magnetic connection between the windings as long as no current is flowing in the control winding and the secondary winding.

Figure 4:
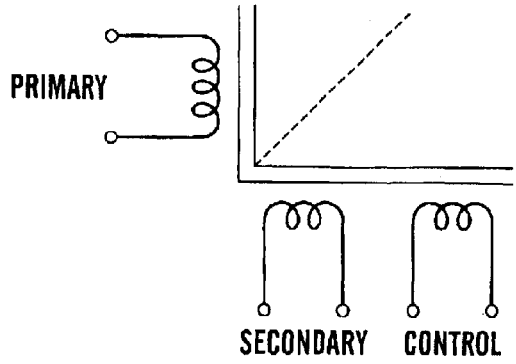
FIG. 4 illustrates a first equivalent circuit for the device according to the invention.
Figure 5A:
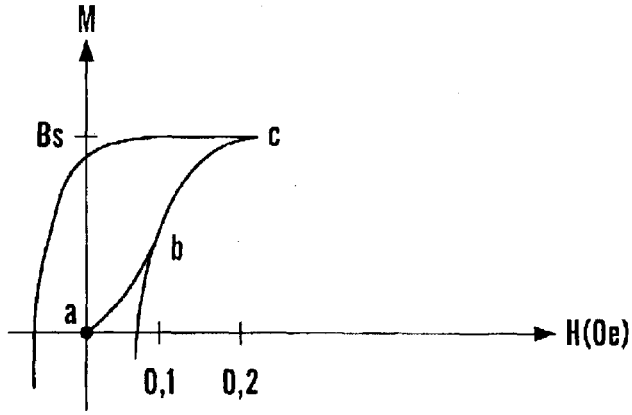
FIGS. 5 and 6 illustrate magnetisation curves and domains for the magnetic material in the device according to the invention.
Figure 5B:
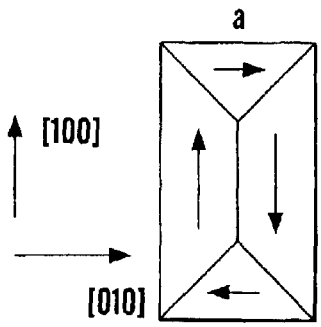
Figure 5C:
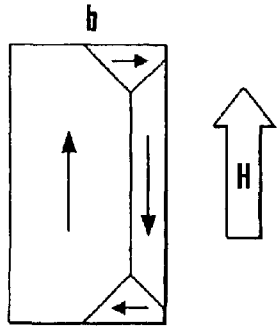
Figure 5D:
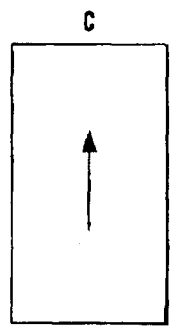

As already mentioned, in FIGS 1*a* and 2*a* winding 4 is the primary winding and winding 2 the secondary winding while winding 3 is the control winding. FIG. 4 shows A1 as the flux area for both secondary winding 2 and control winding 3. This area may be called the area for the internal winding compartment (i.e., iws) A2 is the flux area for the primary winding 4. The area A2 may also be referred to as the area of the external winding compartment (i.e., ews). Depending on the kind of conversion and connection required, it will be possible to give the areas A1 and A2 equal or unequal dimensions.

FIG. 4 is a diagram illustrating the transformer according to the invention where the windings are located with parallel and right-angled axes, and where the magnetisation direction is also represented.

In order to achieve a transformative connection between the two orthogonal windings, the domains and thereby the magnetisation must be aligned in such a manner that the angle between the domains and the windings that have to be influenced is not 90 degrees. The best that can be achieved with connection between two orthogonal windings is to align the magnetisation in the body 1 by means of a control winding to 45 degrees. This means that with an equal number of turns on the primary and the secondary winding and the same flux area, a maximum of approximately 70% of the voltage can be transformed since sinus of 45 degrees is 0.707; because that is the part of the flux area covered by a winding rotated at 45 degrees relative to a source winding.

FIG. 5 illustrates the magnetisation curves for the entire material of the magnetisable body 1 and the domain change under the influence of the H1 field from the secondary winding 2. FIG. 6 illustrates the magnetisation curves for the entire material of the magnetisable body 1 and the domain change under the influence of the H2 field in the direction of the winding 4.

Figure 6A:
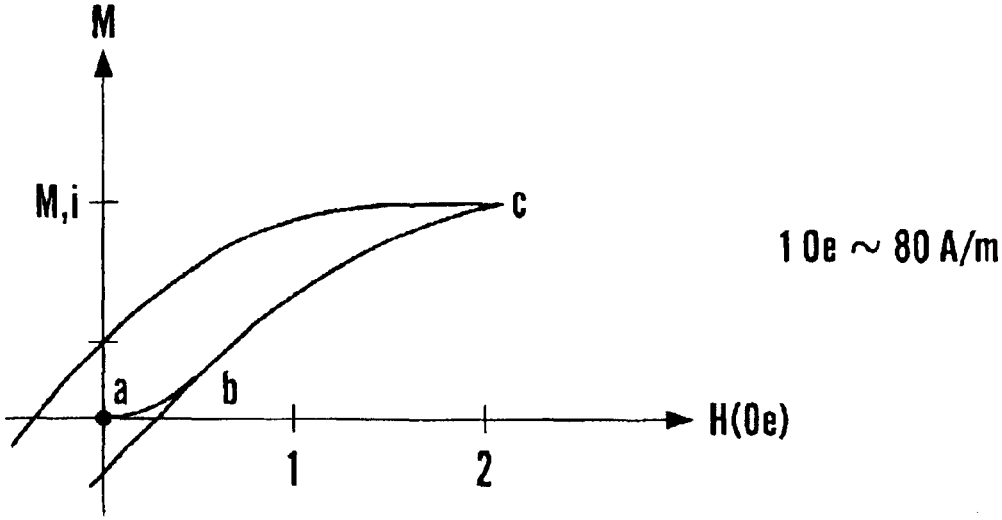
Figure 6B:
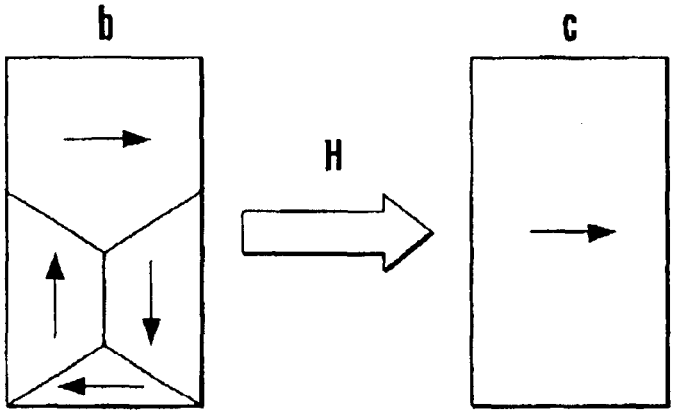
Figure 6C:
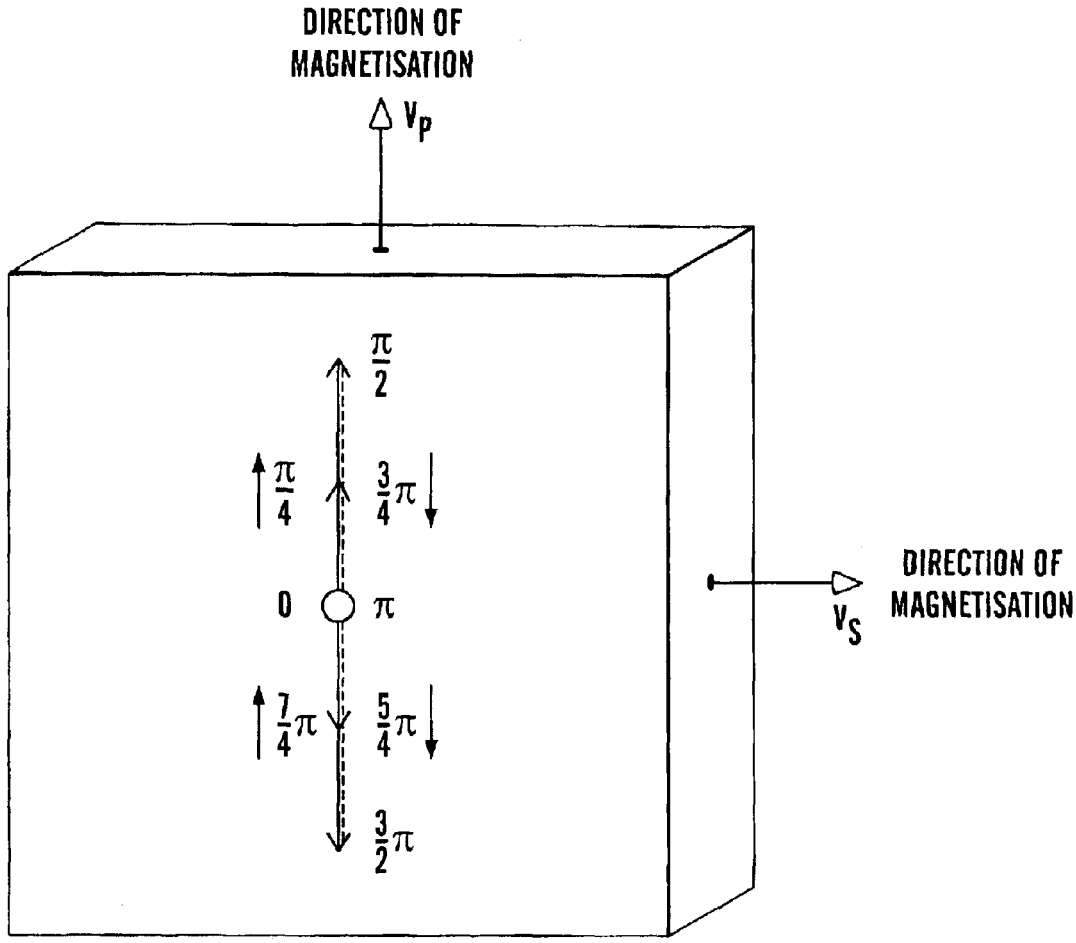
Figure 6C:
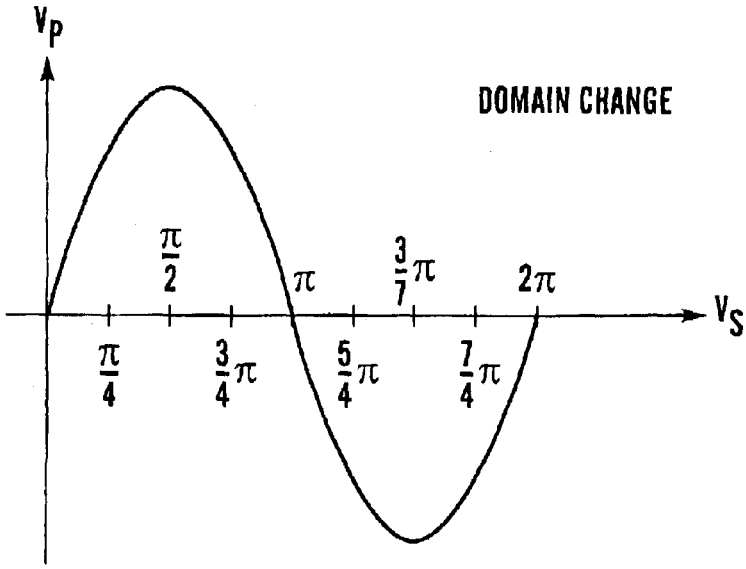
Figure 6D:
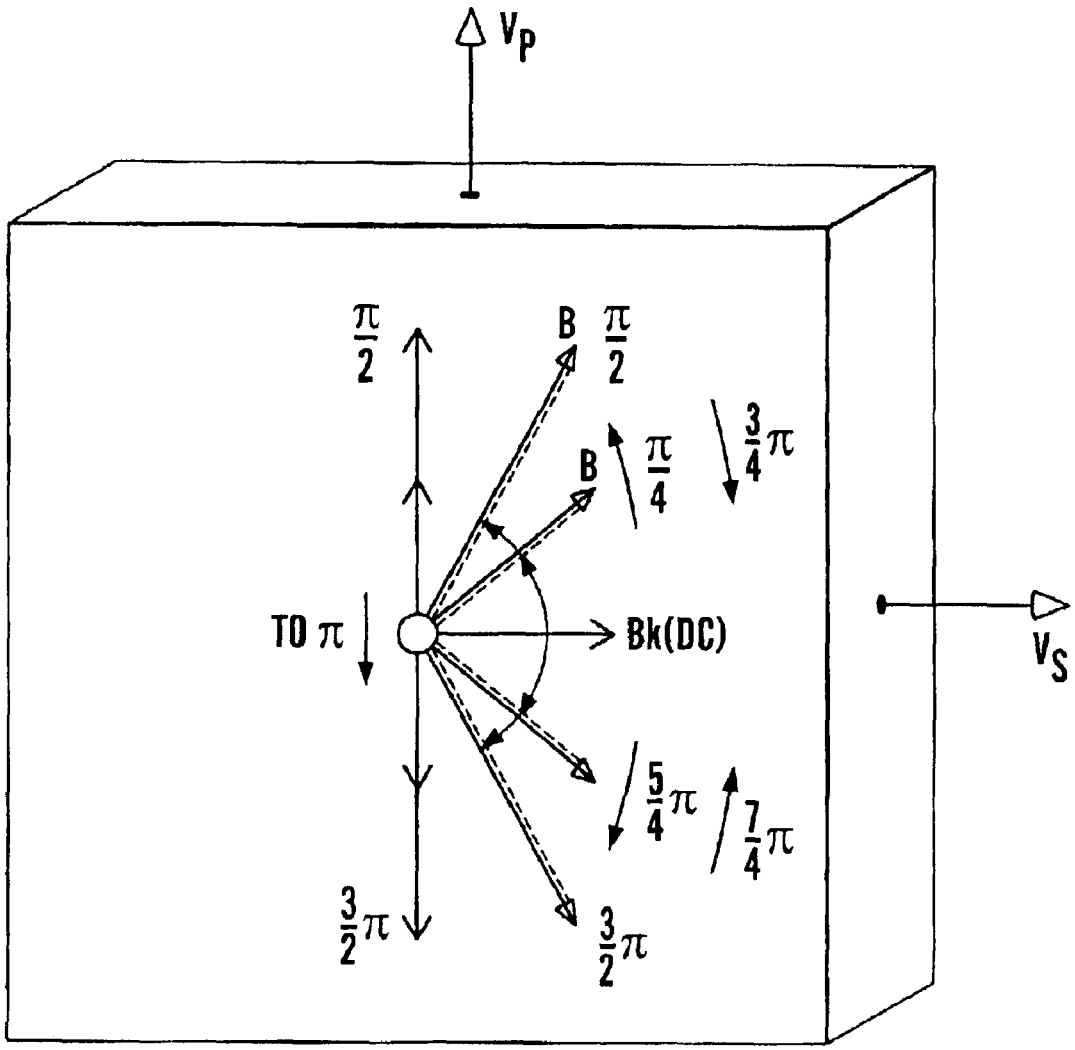

In these FIGS. 6*c* and 6*d*, Vp represents a voltage on the primary winding and Vs a voltage on the secondary winding. At the same time Vp denotes the winding axis of the primary winding and Vs the winding axis of the secondary winding. Flux produced or linked by the primary winding will then have the direction of Vp while flux produced or linked by the secondary winding will have the direction of Vs. In FIG. 6*c* the domains are aligned according to the primary voltage Vp and their magnetisation B will vary roughly as shown in the Figure. The magnetic field H produced by this primary winding will vary from positive to zero and from zero to a negative value.

The phase shift of the magnetisation in relation to the primary voltage is not included here in order to simplify the illustration, (the magnetisation current lags 90 degrees behind the voltage). The magnetisation from the primary winding causes a sinusoidal domain change in a fixed direction in the material given by the primary winding's direction in the compartment:

$$B\mathrm{kvp}=K\mathrm{vp}\cdot\sin(\omega\cdot t) \qquad 1)$$

Where Bkvp is the magnetisation in the direction Vp, k is a constant factor proportional to the primary voltage Vp and t is time. It is now not possible to activate the secondary winding without a control current being impressed from outside in the control winding or in the secondary winding, which rotates the magnetisation from the primary winding so that the field also passes through the secondary winding. As long as the magnetisation B has a direction which is perpendicular to the secondary winding, no flux will be linked by the secondary winding. The length of the arrow illustrates the magnetisation level B or the field strength and the direction of the arrow the direction of alignment of the domains.

In FIG. 6*d*, a control field Bkdc is introduced by activating the control winding and exciting it with DC. The control field is added to the primary field Bkvp, establishing a magnetisation Bkr, as illustrated. Since a constant field is added to a sinusoidal field, the sum will change sinusoidally in direction and sinusoidally in field strength. The simplified diagram 6*d* illustrates that we obtain a change in domain alignment direction that becomes a product of two sinus functions. Both direction and field strength for the resulting field are changed sinusoidally. When domains change size and direction, the body's magnetisation will be altered accordingly. This induces voltages in windings where the domains are under an angle that is not orthogonal to the windings.

The induced voltage Vs in the secondary winding will be given by two effects. The fact that the domains change direction will give an induction and the fact that the domains change in size will give an additional induction.

The directional dependence is given by $$Bkr = Bkvp + Bkdc \quad 2)$$

Where Bkr is the sum of the magnetisation from the primary side Bkvp and the magnetisation Bkdc from the control current.

An additional induction results from the fact that the domains change in size. The field strength is given by 1), and the rotation by 2) so the combined effect will be the product of these two domain changes:

$$Bks = Bkr \cdot Bkvp \quad 3)$$

Simplified to $$Bkp = Kvp\mathbf{2} \cdot \sin^2 (w \cdot t) \quad 4)$$

Disregarding constant term $$Vs = K_2 \cdot \cos(2 \cdot \psi \cdot t) \quad 5)$$

This demonstrates a frequency doubling in the secondary voltage.

This effect of the domain rotation forced on the linear domain changes from the primary current caused by the DC control current will vary by the size of the current and thus the induced voltage.

Figure 6E:
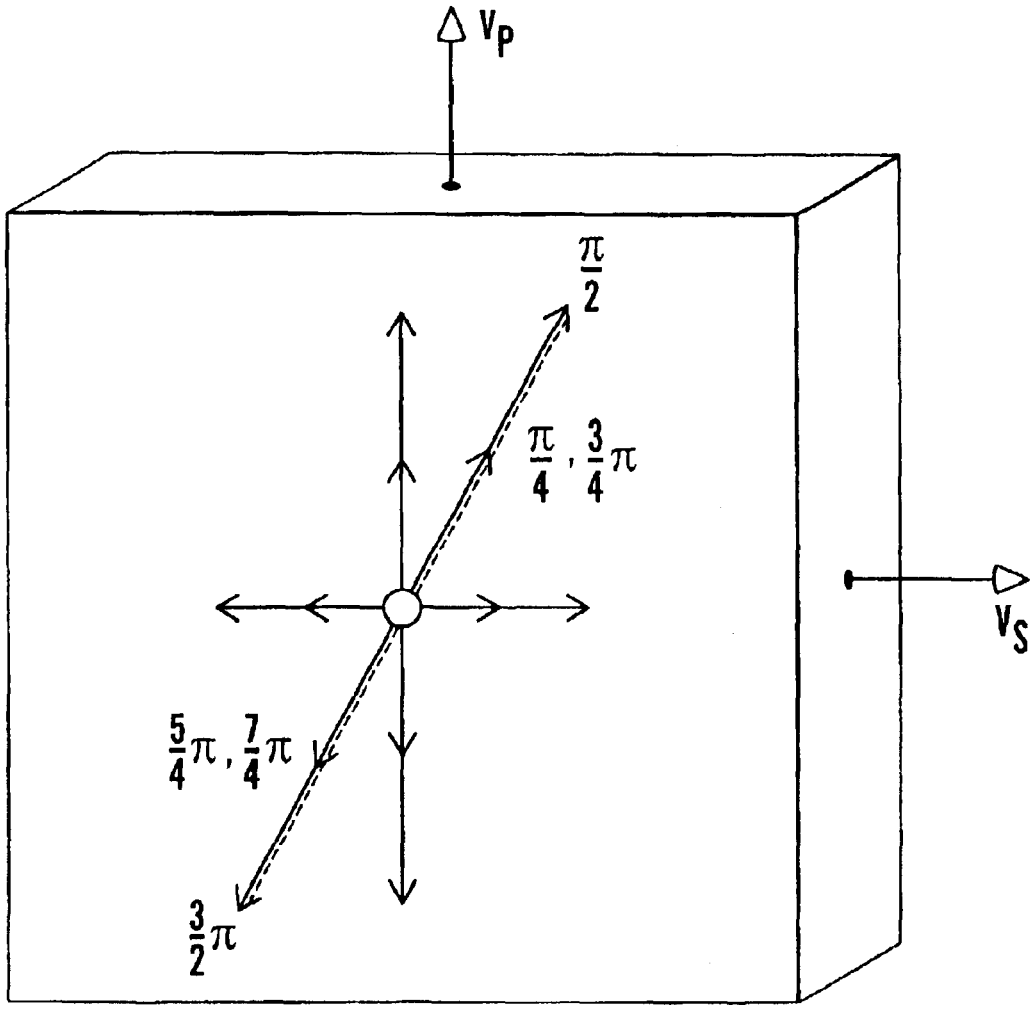
Figure 6F:
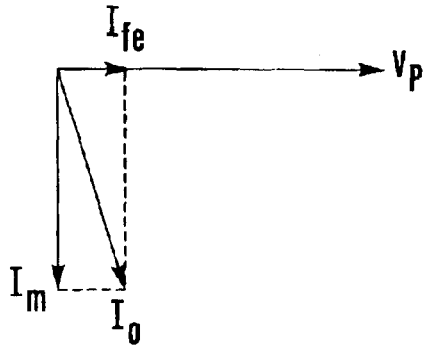

According to an embodiment of the invention the magnetisation is controlled by means of a pulsed DC or pulsed AC control current in a secondary control winding orthogonal to the primary control winding. For example, controlling the magnetisation stepwise with increased voltage from the primary winding with an AC control current in the control winding as illustrated in FIG. 6*e*, the direction of the domains will be kept constant at, e.g., 30 degrees and only the field strength of the magnetisation will be changed in order to avoid a change in both strength and direction simultaneously.

Figure 6G:
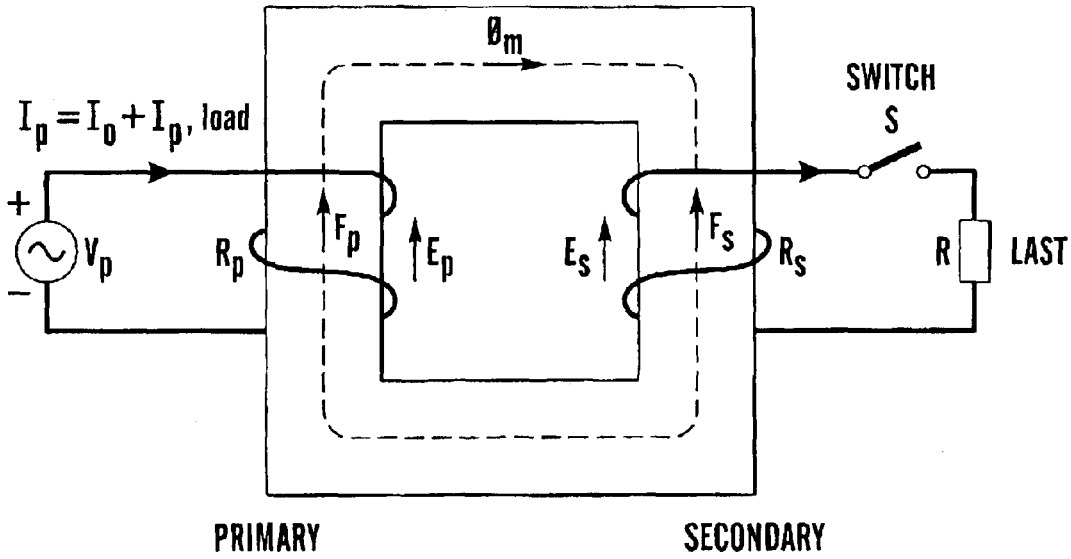

For the magnetic circuit according to an embodiment of the invention, the constant domain direction will be achieved by means of an accurate dosing of the control current in relation to the primary winding's magnetisation current and ampereturn balance with the secondary winding. In an ordinary transformer as illustrated in FIG. 6*g*, the magnetisation current established by the primary winding will be given by the flux required to generate a counter-induced voltage Ep according to Faraday's law.

$$\bar{I}p = \frac{\bar{V}p - \bar{E}p}{Rp} \quad 6)$$

Ep: Voltage induced in the primary winding
Vp: Forced voltage
Rp: Primary winding's resistance
Ip: Primary current $$\bar{I}p = \bar{I}fe + \bar{I}m \quad 7)$$

Disregarding leakage fields, the common flux for primary and secondary winding is given by $$\Phi m = \frac{Np \cdot Im}{Rcore} \quad 7)$$

Np: Primary winding's number of turns
Im: The magnetisation current
Rcore: The reluctance in the core With an open secondary circuit there is only magnetisation current in the primary winding. According to Lenz's law, electromotive voltage induced in the secondary winding (i.e., emf) will be in such a direction that it will counteract the flux change that created it. When the secondary winding is connected to a load (the switch S in FIG. 6*g* is closed), the secondary winding's own magnetomotive force Fs (i.e., mmf) or flux Φs will immediately (in the transient sequence) be established, which will be in the opposite direction to mmf from the primary winding Fp. This result is illustrated in FIG. 6*g*. In a moment, the flux in the core will decrease to $$\Phi m = \frac{Np \cdot im - Ns \cdot is}{Rcore} \quad 8)$$

where is the secondary current and Ns the number of turns in the secondary winding. The flux reduction will lead to a reduction in the induced voltage in the primary winding and thereby according to equation 6) an increase in the primary current. This increased primary current, which is the load current component in the primary current, adds its mmf vectorially to the magnetisation component Np*im, and causes an increase in the primary flux:

$$\Phi m = \frac{Np \cdot im + Np \cdot ip, load - Ns \cdot is}{Rcore} \quad 9)$$

The primary current increases until Np·Ip, load−Ns·is and then Φm and Ep are on the same level as they were before the switch was closed. In stationary operation we will have a current in the primary winding:

$$\bar{I}p = \bar{I}fe + \bar{I}m + Ip,load \quad 10)$$

When the switch opens the same sequence will be repeated in the opposite direction. A secondary mmf develops at the moment the switch is closed. The secondary mmf establishes a magnetisation that is orthogonal to the original magnetisation from the primary winding because the secondary winding is orthogonal to the first. The primary winding responds with a corresponding magnetisation mmf in a direction opposite the secondary winding's mmf and orthogonal to the original magnetisation. Thus, we see that Lenz's law maintains a balance in the flux, with every load change on the secondary side being met by a corresponding change on the primary side, thus achieving a balance, with the result that in a stationary state we will only have the magnetisation flux flowing in the core that is the cause of the transformer effect. This description applies for an ordinary transformer with primary and secondary winding in the same winding compartment.

Since the sum of the magnetisation currents is the cause of the transformer effect, it is desirable to keep the controlled part of the magnetisation current in the secondary circuit unaffected by load changes in the secondary circuit, i.e. the current in the control winding is kept constant during a load change. By introducing a suitable inductance in the control winding, e.g. by means of the prior art from PCT/NO01/00217, the current in the control winding will be perceived as constant during domain changes caused by load changes in the secondary circuit. The current in the control winding appears constant because an inductance will "smooth" the changes in the current. Because the transformer effect is now present, the control winding will also be under induction from the primary voltage Vp.

The control winding is also directly transformatively connected to the secondary winding and a control voltage in the control winding will be transformed to the secondary winding. At the same time, current in the secondary winding will now influence the domain distortion and the phase ratio between primary and secondary winding. In order to remedy this situation, all currents in the system must be monitored and the control winding must be excited so as to compensate for domain changes established by the secondary winding. In order to prevent power that passes from the control circuit to the secondary circuit from influencing the power transferred between these two circuits, as mentioned earlier, an inductance is introduced in the control circuit that causes an approximately constant current in the control winding and provides a sufficient drop in voltage between the control winding and the secondary winding. The transformed voltage in the secondary winding from the primary side and the transformed voltage in the secondary winding from the control winding will be in phase or in antiphase, since we have basically used a control voltage that should be in phase with the primary voltage in order to obtain a directionally constant domain change. It is also important to be aware that the core is reset at every zero passage in the voltages. Thus, by removing the control current the magnetisation angle between the windings will decrease due to the fact that the secondary current decreases and after a few periods we are back to minimal connection.

Figure 6H:
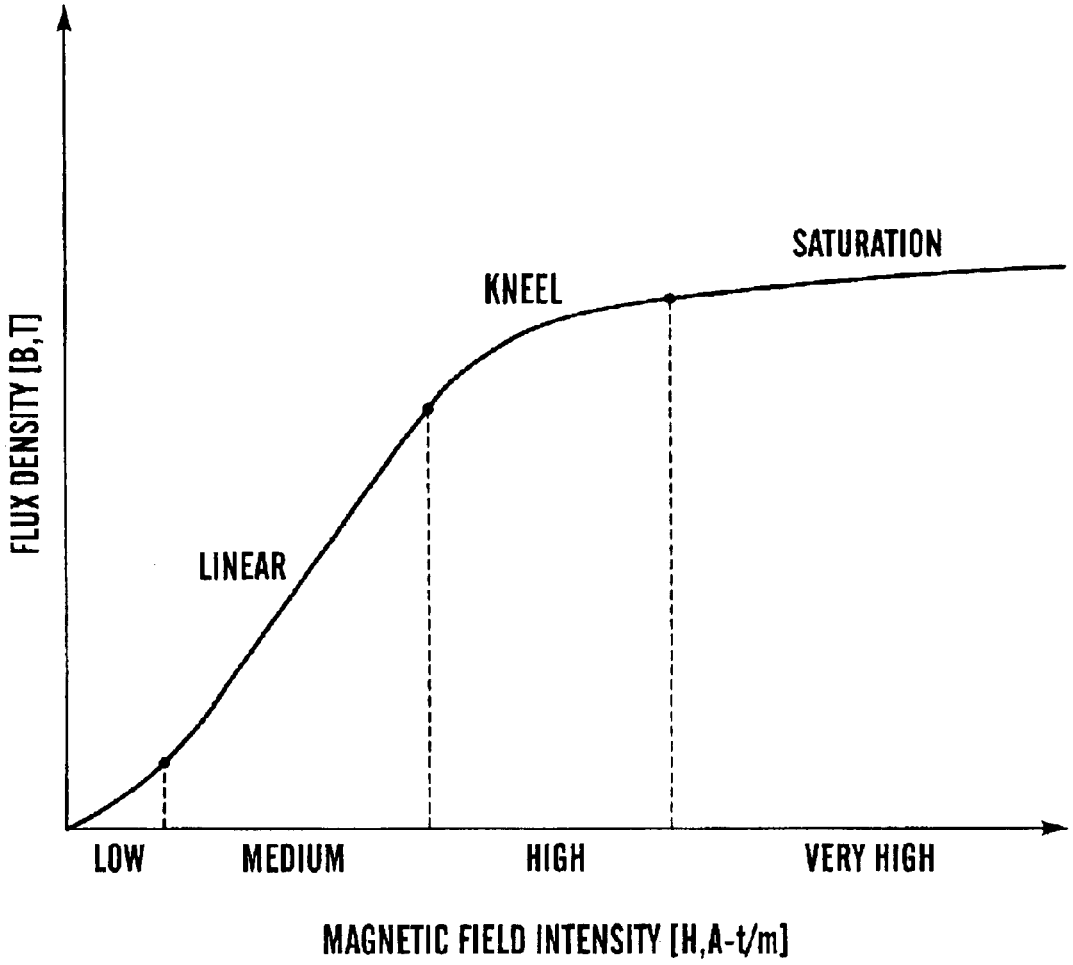

FIG. 6*h* illustrates the linear part of the magnetisation curve for a standard commercial core plate.

The transformative connection between the primary and the secondary side will be as for an ordinary transformer as long as the transformation occurs in the linear region of the magnetisation curve and as long as the directional dependence of the permeability in the plate is approximately symmetrical and the control current is in phase with the primary voltage and of such a strength that the direction of the domains is not changed during the primary voltage sequence.

Figure 7A:
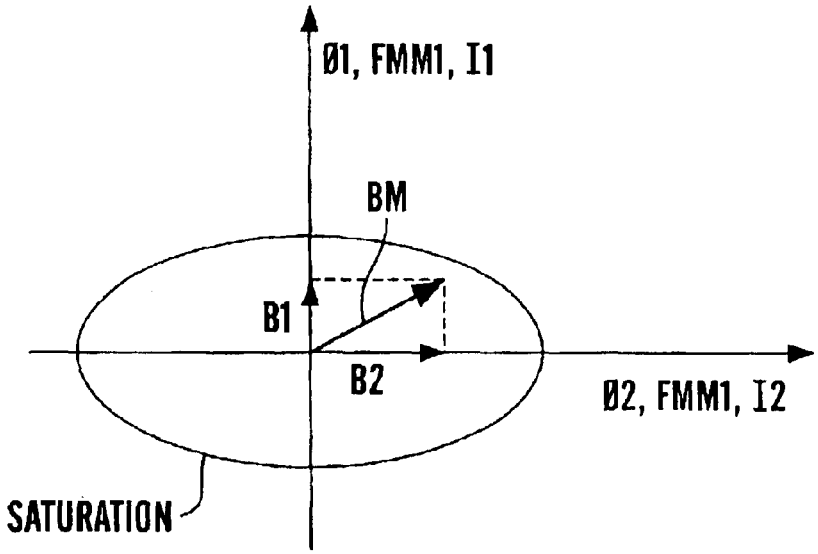
FIG. 7 illustrates flux densities for the main and the control winding.
Figure 7B:
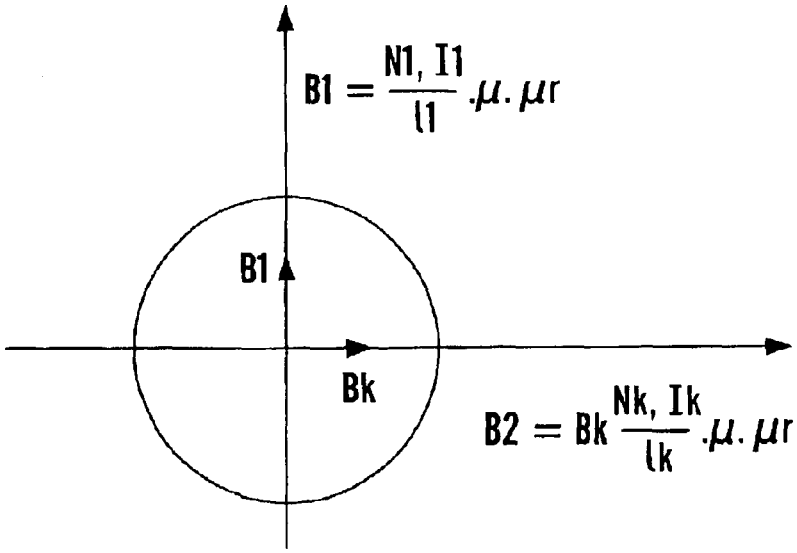

FIGS. 7*a* and 7*b* illustrate the flux densities B1 (where the field H1 is established by the secondary winding) and B2 (corresponding to the primary current). The ellipse illustrates the saturation limit for the B fields, i.e. when the B field reaches the limit, this will cause the material of the magnetisable body 1 to reach saturation. The design of the ellipse's axes will be given by the field length and the permeability of the two fields B1 (H1) and B2 (H2) in the core material of the magnetisable body 1.

By letting the axes in FIG. 7 express the MMK distribution or the H-field distribution, a picture can be seen of the magnetomotive force from the two currents I1 and I2. The operative range of the transformer will be within the saturation limit and it is particularly important to take account of this when designing the transformer for the magnetisation fields in a connection between two orthogonal windings.

Figure 8E:
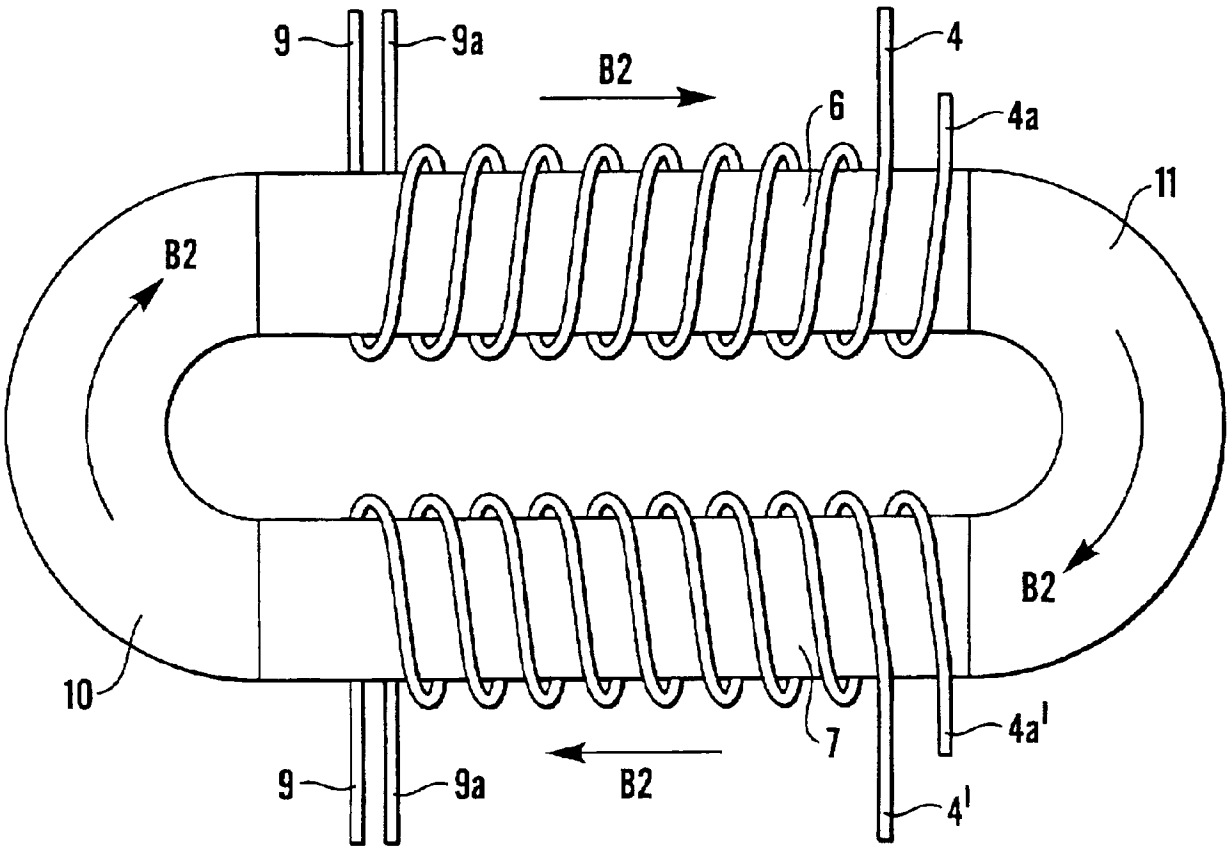
FIG. 8 illustrates a second embodiment of the invention.
Figure 8A:
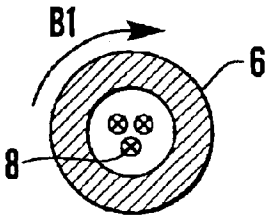
Figure 8B:
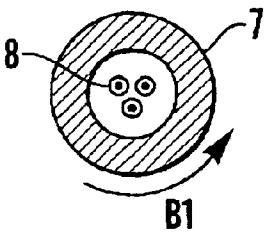

FIG. 8 is a schematic illustration of a second embodiment of the invention.

Figure 9B:
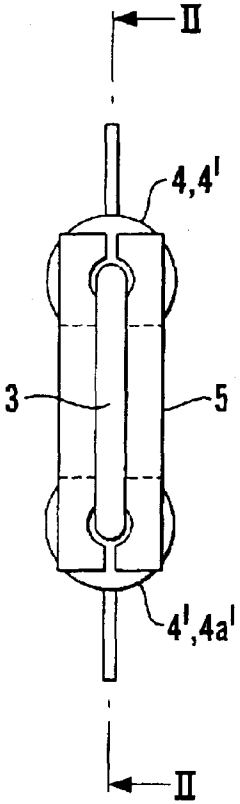
FIG. 9 illustrates the same second embodiment of the invention.
Figure 9A:
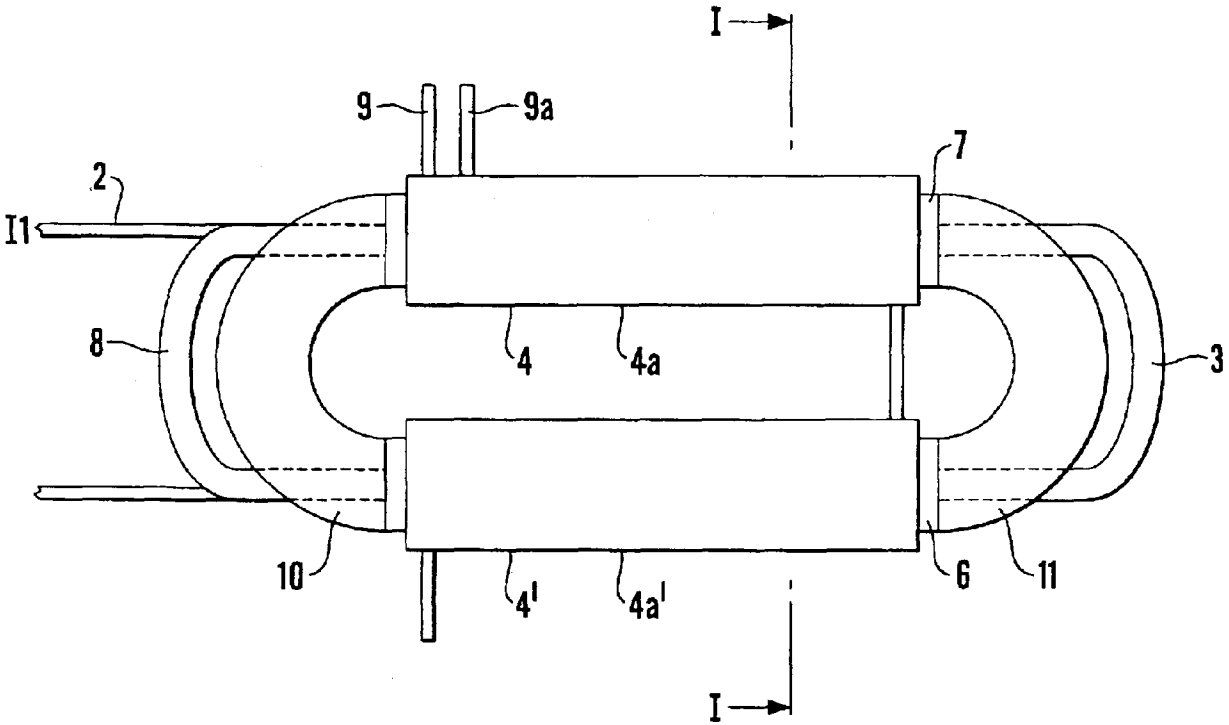

FIG. 9 illustrates the same embodiment of a magnetically influenced connector according to the invention, where FIG. 9*a* illustrates the assembled connector and FIG. 9*b* is an end view of the connector.

Figure 10:
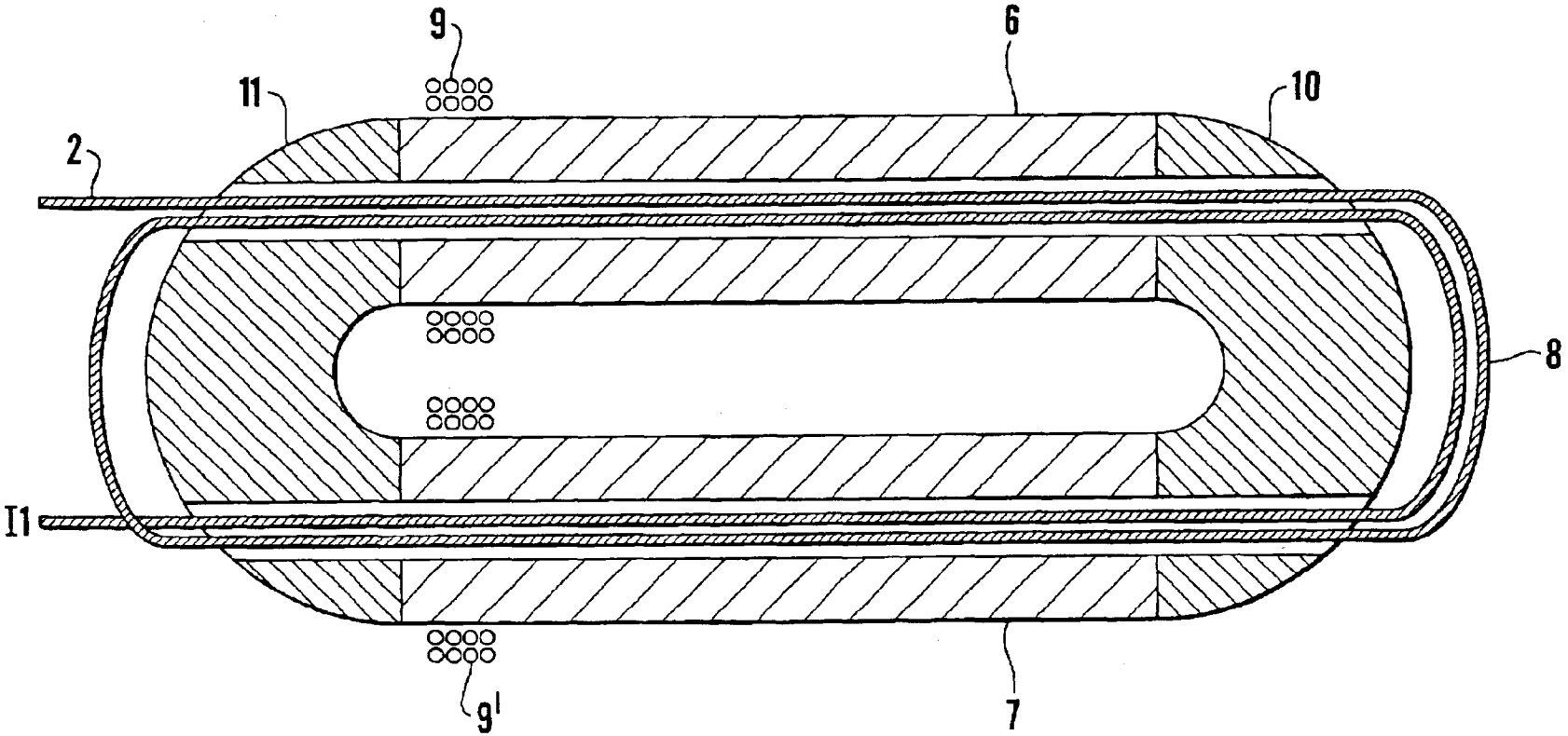
FIGS. 10 and 11 illustrate the second embodiment in section.

FIG. 10 illustrates a section along line II in FIG. 9*b*.

As illustrated, for example, in FIG. 10, the magnetisable body 1 is composed inter alia of two parallel tubes 6 and 7 made of a magnetisable material. An electrically insulated conductor 8 (FIGS. 9*a*, 10) is passed continuously in a path through the first tube 6 and the second tube 7 a quantity of N times, where N=1, . . . r. The conductor 8 forms the primary main winding 2, with the conductor 8 extending in the opposite direction through the two tubes 6 and 7, as is clearly illustrated in FIG. 10. Even though the conductor 8 is only shown extending twice through the first tube 6 and the second tube 7, it should be self-explanatory that it is possible for the conductor 8 to extend through the respective tubes either only once or possibly several times (as indicated by the fact that the winding number N can vary from 0 to r), thereby creating a magnetic field H1 in the parallel tubes 6 and 7 when the conductor is excited. A combined control and secondary winding 4,4', composed of the conductor 9, is wound round the first tube and the second tube (6 and 7 respectively), in such a manner that the direction of the field H2 (B2) that is created on the said tubes when the winding 4 is excited will be oppositely directed, as indicated by the arrows for the field B2 (H2) in FIG. 8. Magnetic field connectors 10, 11 are mounted at the ends of the respective tubes 6, 7 in order to interconnect the tubes fieldwise in a loop. The conductor 8 will be able to convey a load current I1 (FIG. 9*a*). The tubes' 6, 7 length and diameter will be determined on the basis of the power and voltage that have to be connected. The number of turns N1 on the main winding 2 will be determined by the reverse blocking ability for voltage and the cross-sectional area for the magnitude of the working flux Φ2. The number of turns N2 on the control winding 4 is determined by the conversion ratio required for the special transformer.

Another possibility is to arrange the winding 4 as primary winding and the winding 2 as control and secondary winding.

Figure 11:
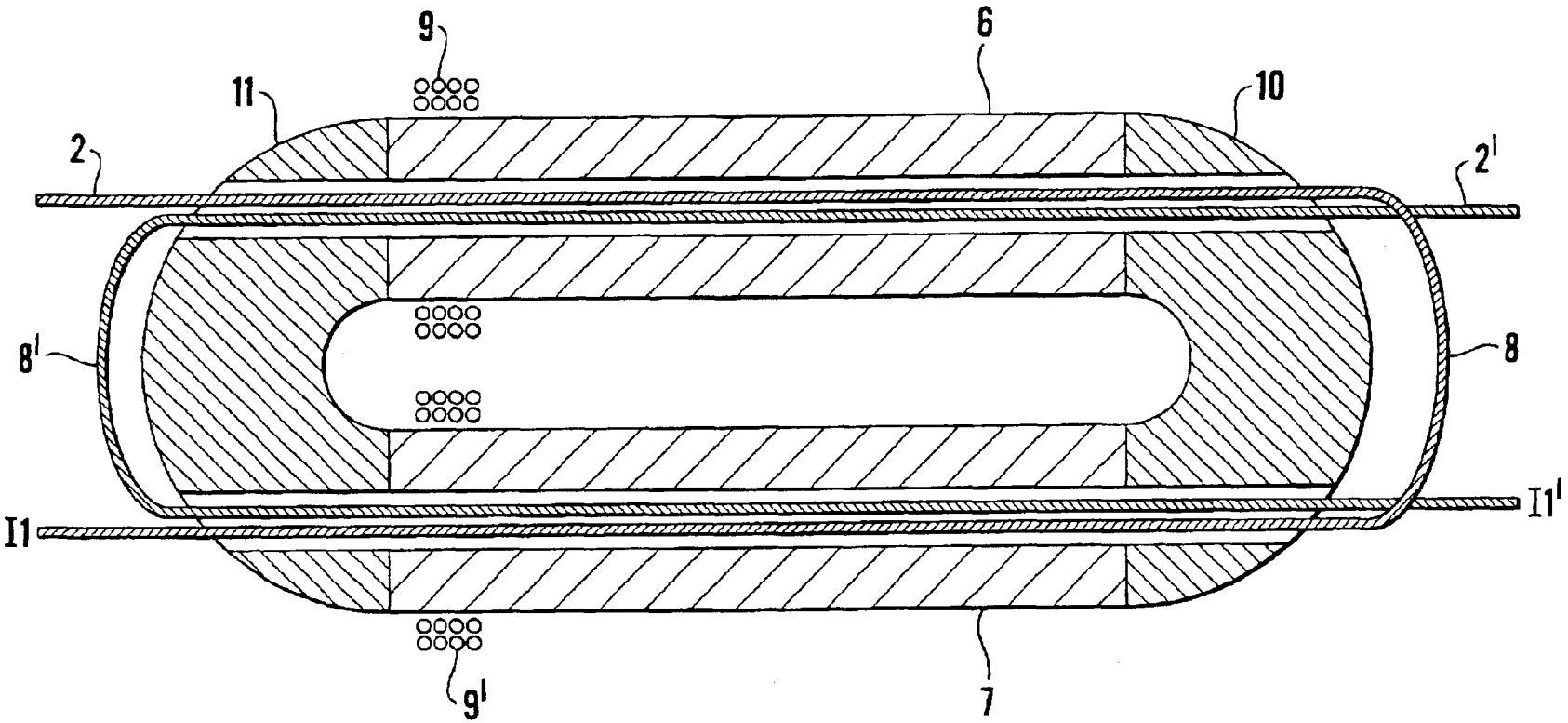

FIG. 11 illustrates an embodiment where the primary and the secondary main windings have been interchanged. The solution in FIG. 11 differs from that illustrated in FIGS. 9*a* and 10 by the fact that instead of a single insulated conductor 8, which is passed through the tubes 6 and 7, two separate oppositely directed conductors pass through the tubes 6, 7. In this embodiment, secondary conductors 8 and control conductors 8' are employed, in order to achieve a voltage converter function in the magnetically influenced device according to the invention. The design basically resembles that illustrated in FIGS. 8, 9 and 10. The magnetisable body 1 comprises two parallel tubes 6 and 7. An electrically insulated secondary conductor 8 is passed continuously in a path through the first tube 6 and the second tube 7 a quantity of N1 times, where N1=1, . . . r. The conductor 8 extends in the opposite direction through the two tubes 6 and 7. An electrically insulated control conductor 8' is passed continuously in a path through the first tube 6 and the second tube 7 for a quantity of N1' times, where N1'=1, . . . r. The conductor 8' extends in the opposite direction relative to the conductor 8 through the two tubes 6 and 7. At least one primary winding 4 and 4' is wound round the first tube 6 and the second tube 7 respectively. As a result, the field direction created on the tubes is oppositely directed. In a similar manner as the embodiment according to FIGS. 8, 9 and 10, the magnetic field connectors 10, 11 are mounted at the end of the respective tubes 6, 7 in order to interconnect the tubes 6 and 7 fieldwise in a loop and form the magnetisable body 1. Even though for the sake of simplicity in the drawings, the conductor 8 and the conductor 8' are illustrated with only one pass through the tubes 6 and 7, it will be immediately apparent that both the conductor 8 and the conductor 8' can be passed through the tubes 6 and 7 for a quantity of N1 and N1' times respectively. The length and diameter of tubes' 6 and 7 will be determined on the basis of the power and voltage that have to be converted. For a transformer with a conversion ratio (N1:N') equal to 10:1, in practice, ten conductors will be used as conductors 8 and only one conductor 4.

Figure 12A:
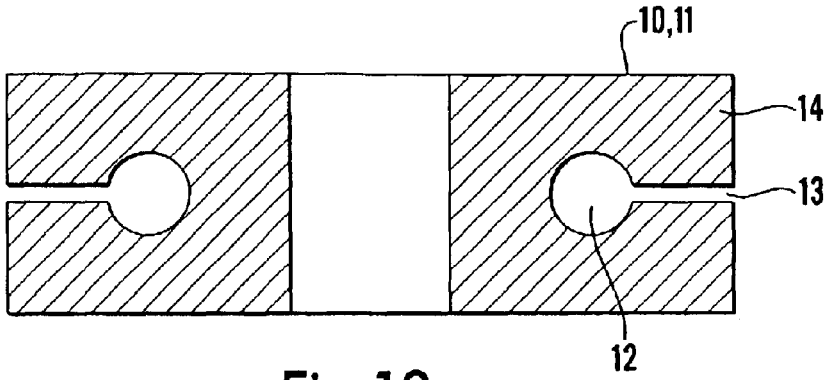
FIGS. 12–15 illustrate various embodiments of the magnetic field connectors in the said second embodiment of the invention.
Figure 12B:
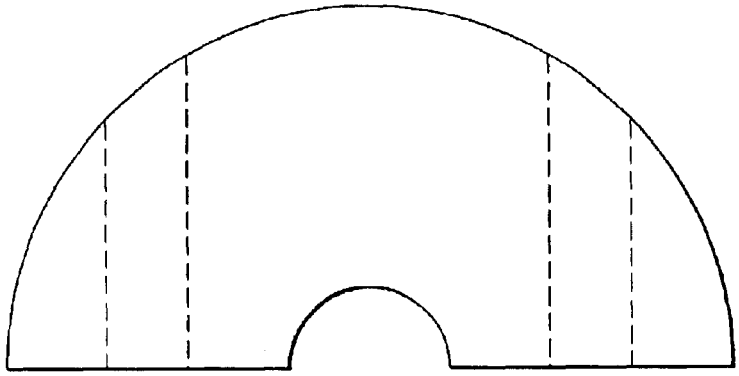
Figure 12C:
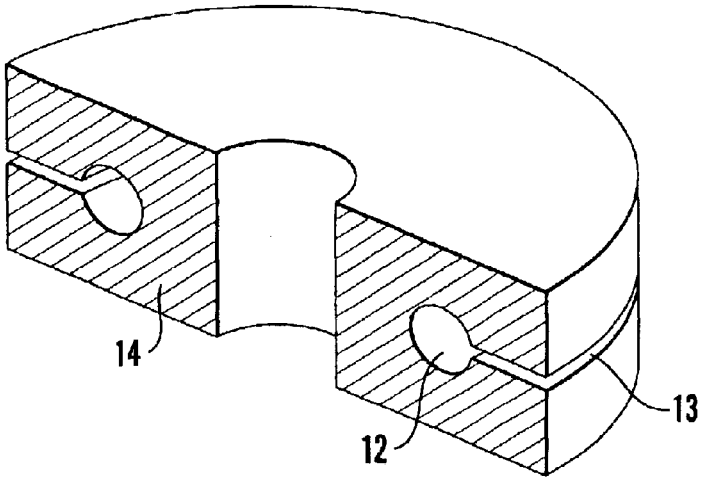

An embodiment of a magnetic field connector 10 and/or 11 is illustrated in FIG. 12. A magnetic field connector 10, 11 is illustrated composed of magnetically conducting material, wherein two preferably circular apertures 12 for the conductor 8 in the winding 2 (see, e.g., FIG. 10) are machined out of the magnetic material in the connectors 10, 11. Furthermore, a gap 13 is provided which interrupts the magnetic field path of the conductor 8. End surface 14 is the connecting surface for the magnetic field H2 from the winding 4 consisting of conductor 9 and 9' (FIG. 10).

Figure 13:
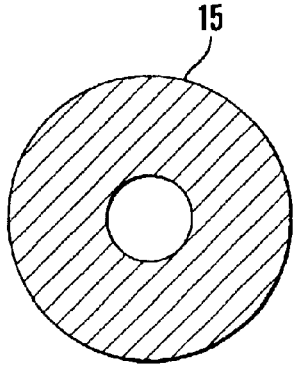

FIG. 13 illustrates a thin insulating film 15 which will be placed between the end surface of tubes 6 and 7 and the magnetic field connector 10, 11 in a preferred embodiment of the invention.

Figure 14A:
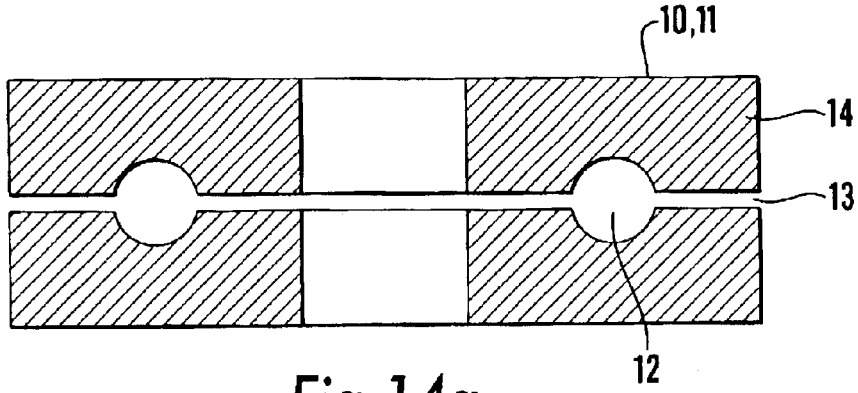
Figure 14B:
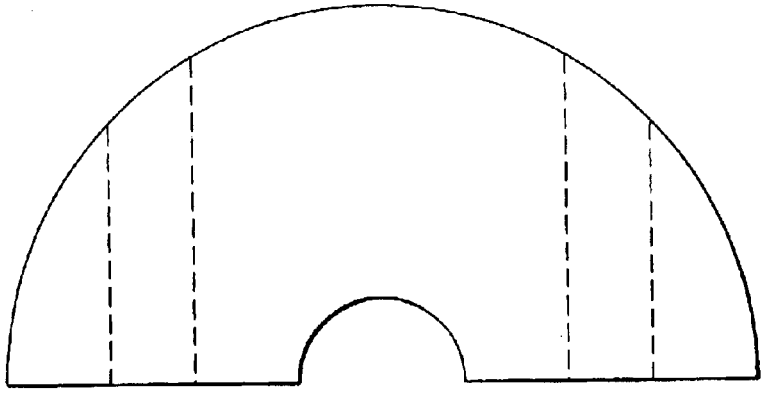
Figure 14C:
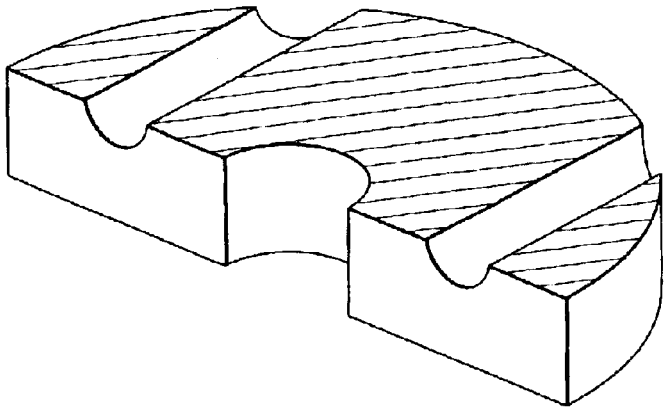
Figure 15A:
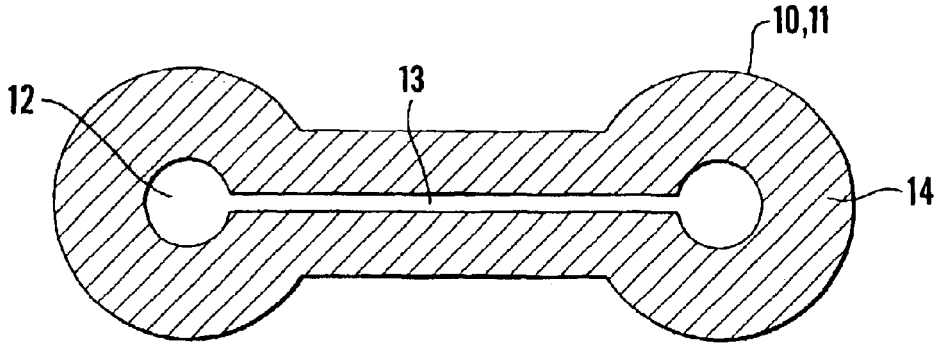
Figure 15B:
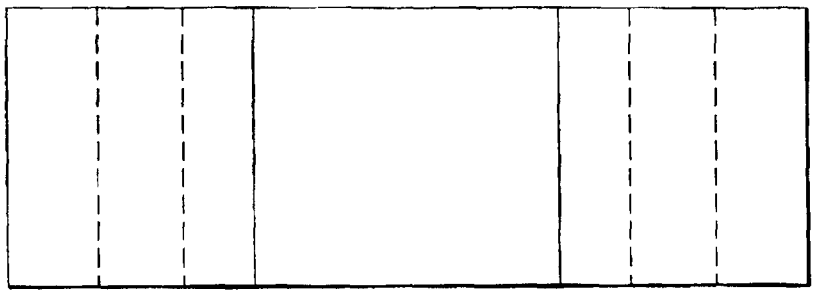
Figure 15C:
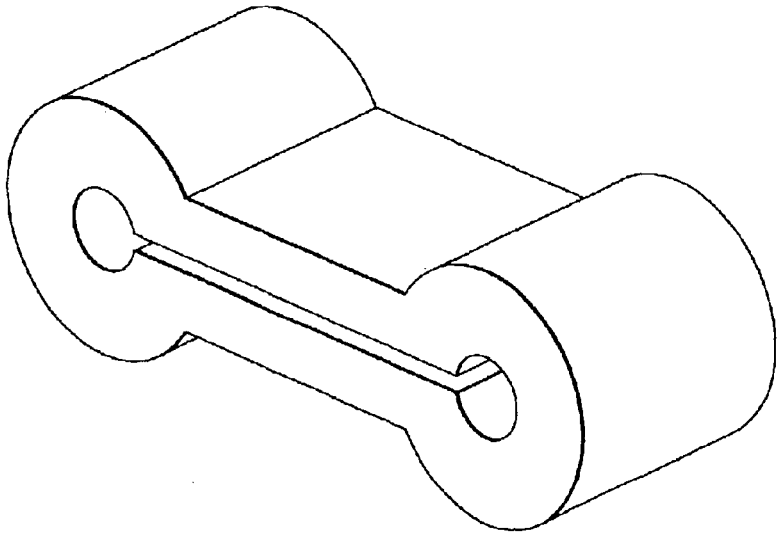

FIGS. 14 and 15 illustrate other alternative embodiments of the magnetic field connectors 10, 11.

FIGS. 16–29 illustrate various embodiments of a core 16, which in the embodiment illustrated in FIGS. 9, 10 and 11 forms the main part of the tubes 6 and 7. In versions of these embodiments, the tubes together with the magnetic field connectors 10 and 11 form the magnetisable body 1.

Figure 16:
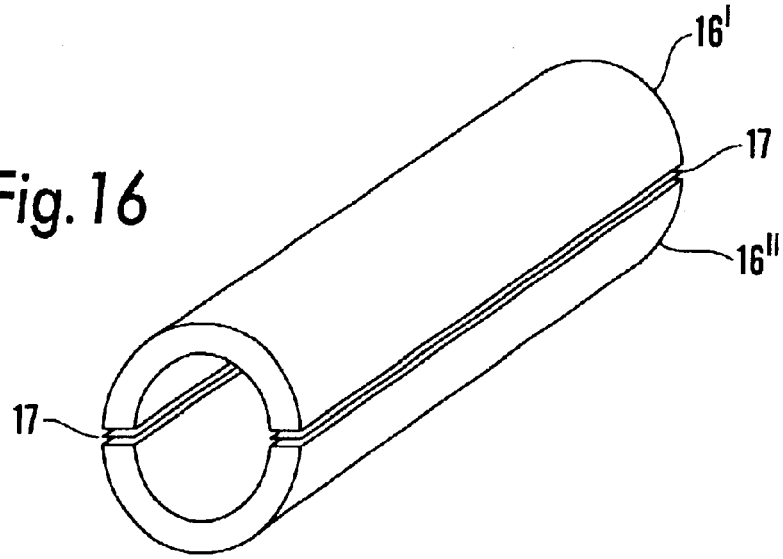
FIGS. 16–29 illustrate various embodiments of the tubular bodies in the second embodiment of the invention.

FIG. 16 illustrates a cylindrical core part 16, which is divided lengthwise as illustrated and where one or more layers 17 of insulating material are placed between the two core halves 16,' 16".

Figure 17:
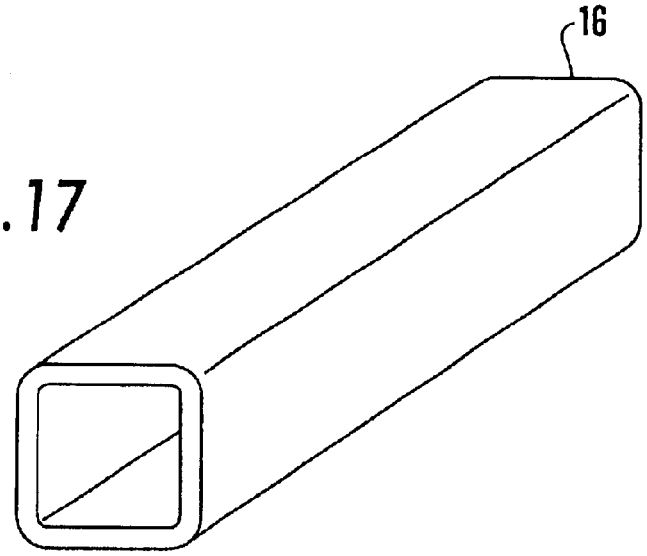
Figure 18:
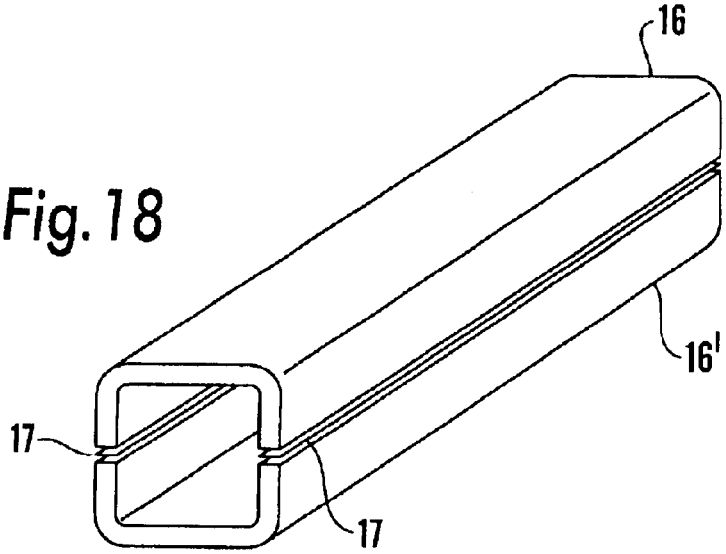
Figure 19:
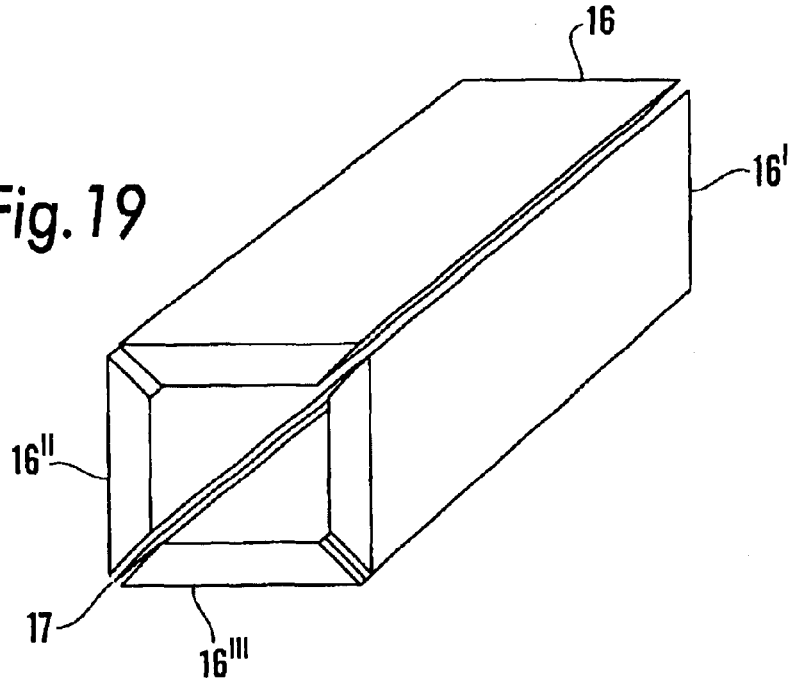

FIG. 17 illustrates a rectangular core part 16 and FIG. 18 illustrates an embodiment of this core part 16 where it is divided in two with partial sections in the lateral surface. In the embodiment illustrated in FIG. 18, one or more layers of insulating material 17 are placed between the core halves 16, 16'. A further version is illustrated in FIG. 22 where the partial section is placed in each corner.

Figure 20:
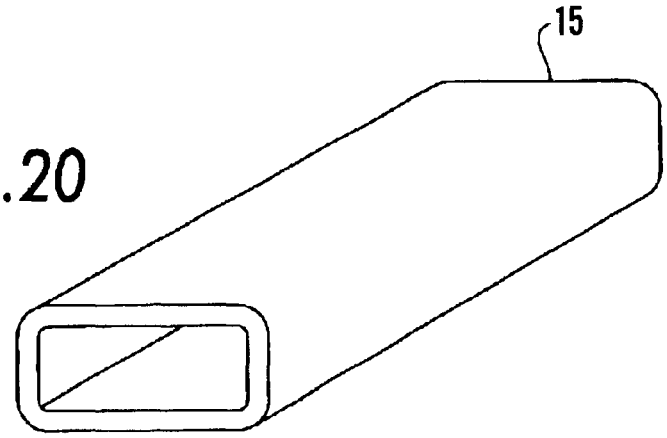
Figure 21:
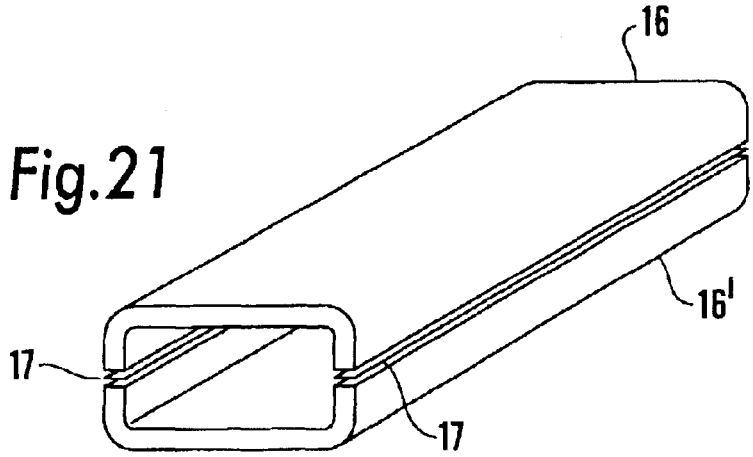
Figure 22:
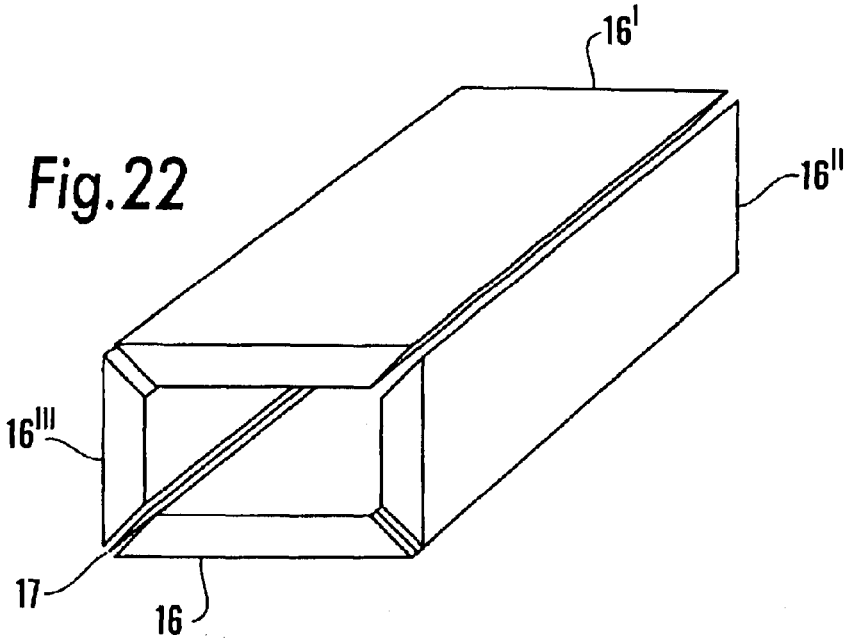
Figure 23:
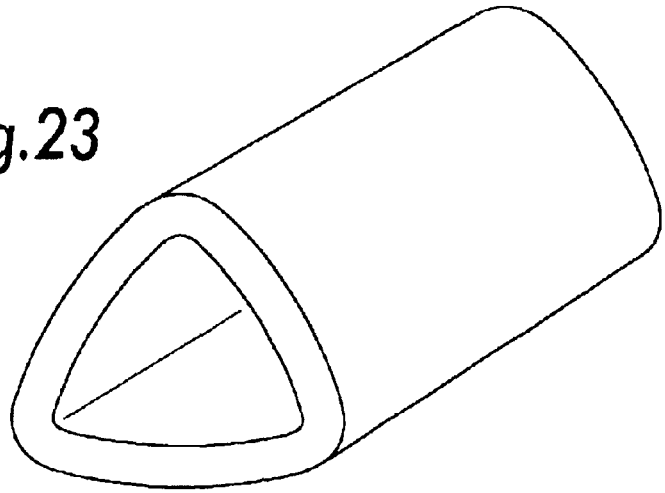
Figure 24:
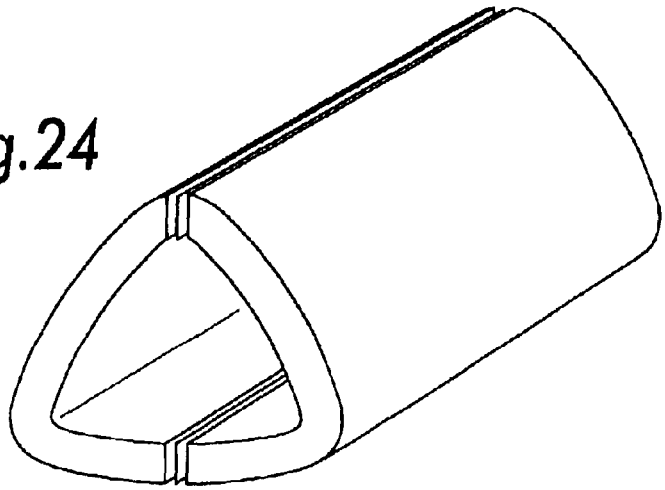
Figure 25:
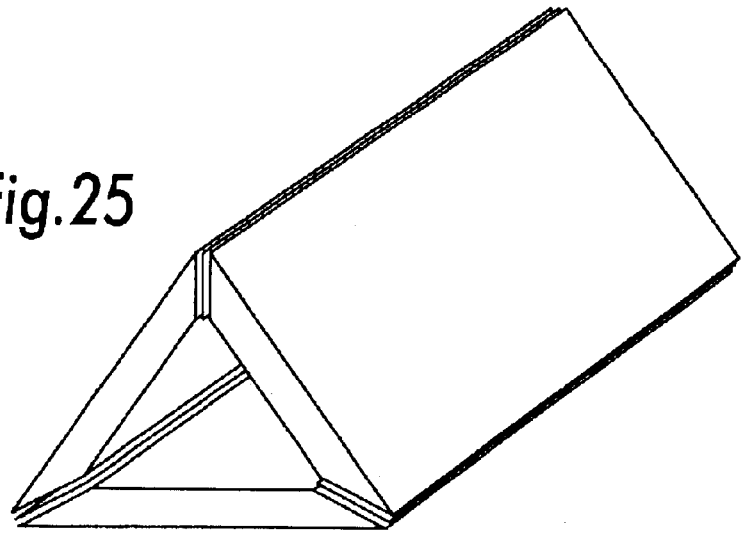
Figure 26:
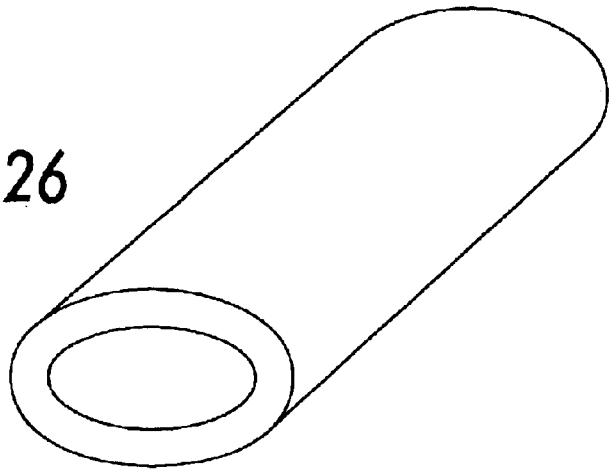
Figure 27:
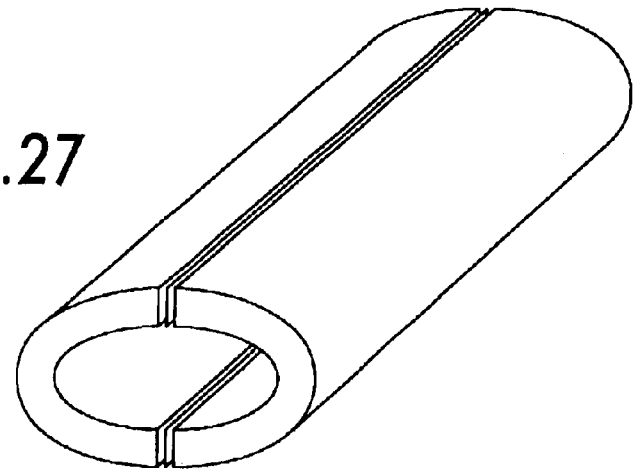
Figure 28:
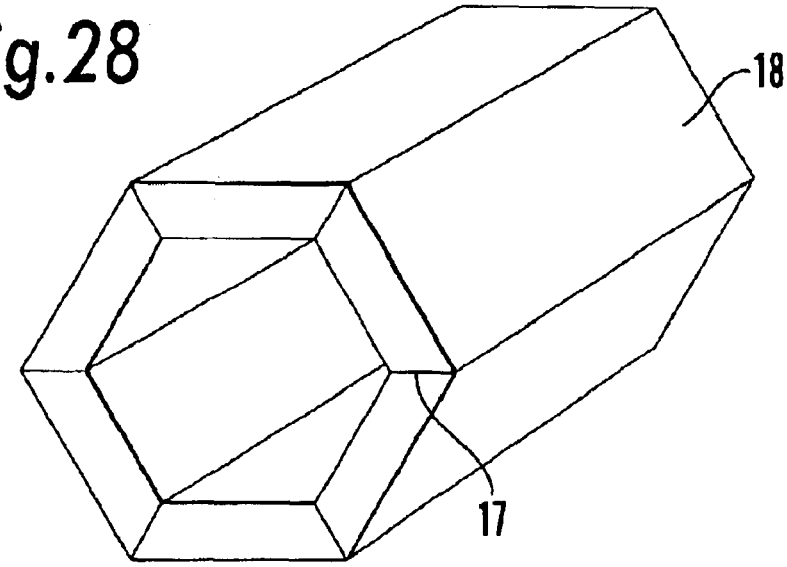
Figure 29:
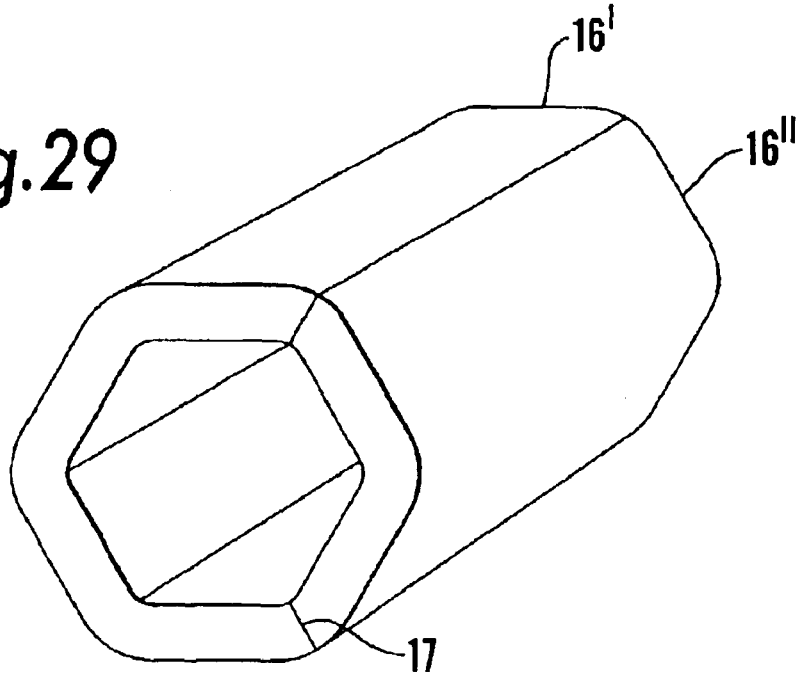
Figure 30A:
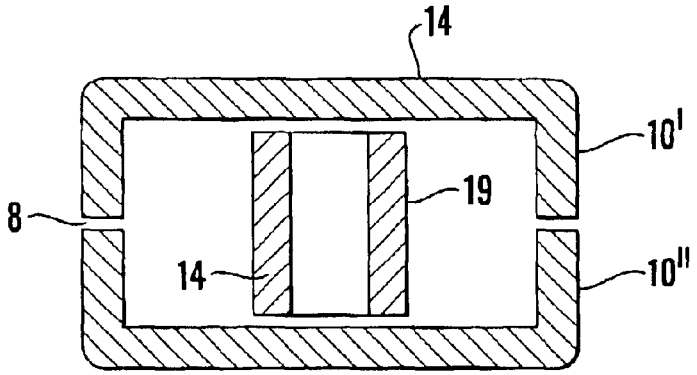
FIGS. 30–35 illustrate different aspects of magnetic field connectors for use in the second embodiment of the invention.
Figure 30B:
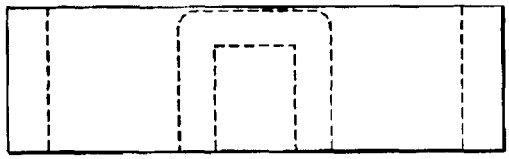
Figure 30C:
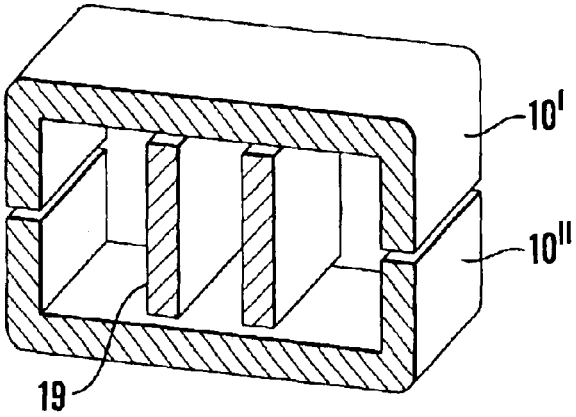
Figure 30D:
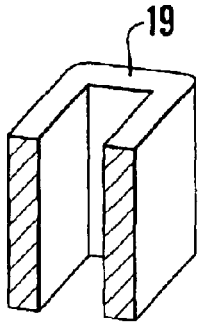

FIGS. 20, 21 and 22 illustrate a rectangular shape. FIGS. 23, 24 and 25 illustrate the core 16 in triangular shaped embodiments. FIGS. 26 and 27 illustrate oval embodiments. FIGS. 28 and 29 illustrate the core 16 in hexagonal shaped embodiments. In FIG. 28, the hexagonal shape is composed of 6 equal surfaces 18 and in FIG. 27 the hexagon consists of two parts 16' and 16". Reference numeral 17 refers to a thin insulating film.

Figure 31:
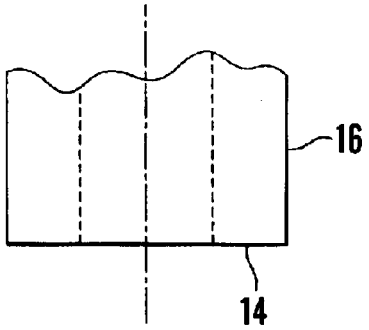

FIGS. 30 and 31 illustrate a magnetic field connector 10, 11 that can be used as a control field connector between the rectangular and square main cores 16 (illustrated in FIGS 10–11 and 20–22 respectively). This magnetic field connector comprises three parts 10', 10" and 19.

FIG. 31 illustrates an embodiment of a core part or main core 16 where the end surface 14 or the connecting surface for the control flux is at right angles to the axis of the core part 16.

Figure 32:
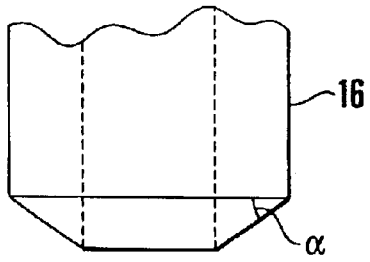

FIG. 32 illustrates a second embodiment of the core part 16 where the connecting surface 14 for the control flux is at an angle $\alpha$ relative to the axis of the core part 16.

FIGS. 33–39 illustrate various embodiments of the magnetic field connector 10, 11, which are based on the fact that the connecting surfaces 14' of the magnetic field connector 10, 11 are at the same angle as the end surfaces 14 as the core part 16.

Figure 33:
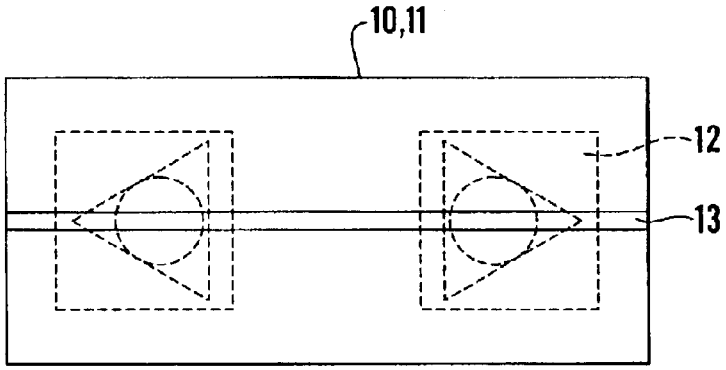

FIG. 33 illustrates an embodiment of the magnetic field connector 10, 11 in which different hole shapes 12 are indicated for the main winding 2 based on the shape of the core part 16 (round, triangular, etc.).

Figure 34:
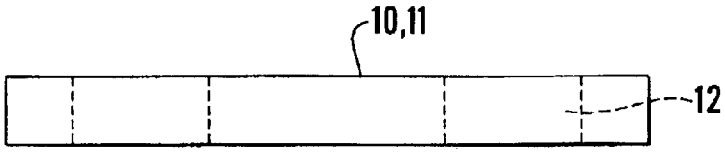

In FIG. 34, the magnetic connector 10, 11 is flat. It is adapted for use with core parts 16 with right-angled end surfaces 14.

Figure 35:
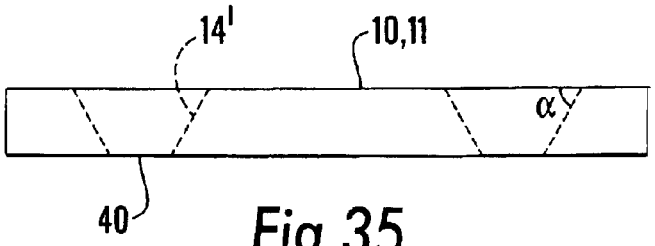

In FIG. 35 an angle $\alpha'$ is indicated to the magnetic field connector 10, 11, which is adapted to the angle $\alpha$ to the core part 16 (FIG. 32) with the result that the end surface 14 and the connecting surface 14' coincide.

Figure 36A:
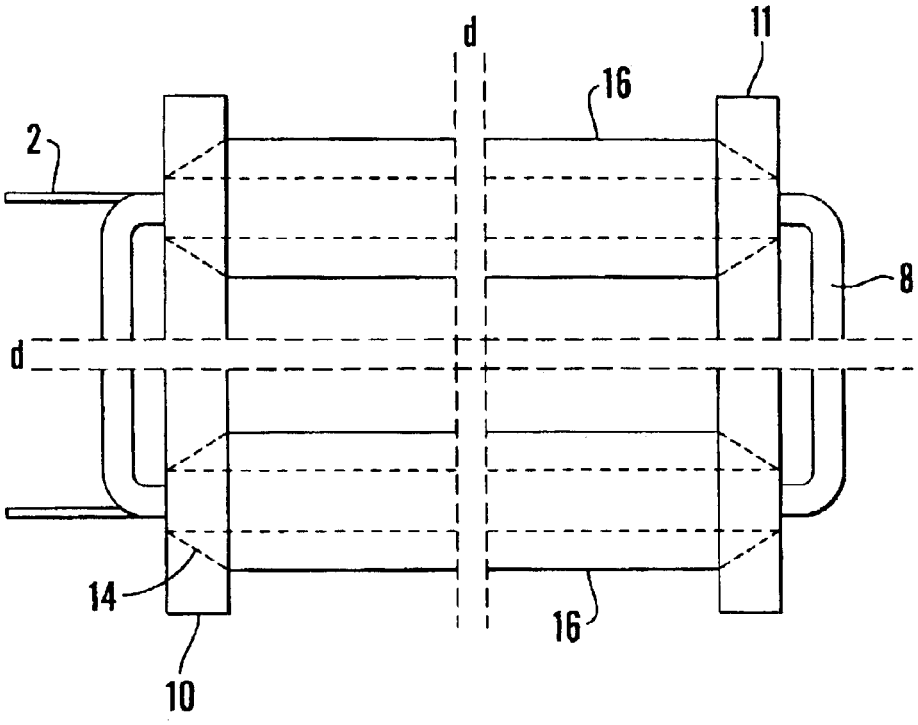
FIG. 36 illustrates an assembled device according to the second embodiment of the invention.
Figure 36B:
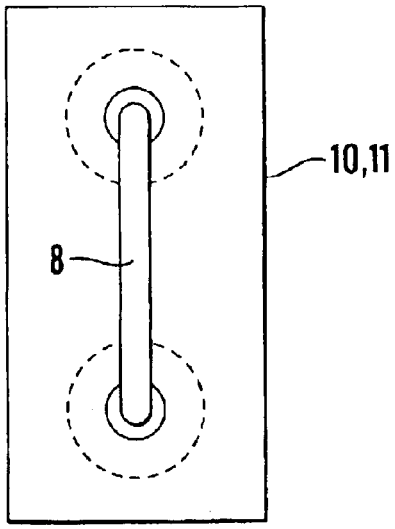

In FIG. 36*a* an embodiment of the invention is illustrated with an assembly of magnetic field connectors 10, 11 and core parts 16. FIG. 36*b* illustrates the same embodiment viewed from the side.

Even though only a few combinations of magnetic field connectors and core parts are described in order to illustrate the invention, it will be obvious to a person skilled in the art that other combinations are entirely possible and will therefore fall within the scope of the invention.

It will also be possible to switch the positions of the primary winding and the secondary and control windings. However, the control winding will preferably follow the same winding compartment as the secondary winding.

Figure 37A:
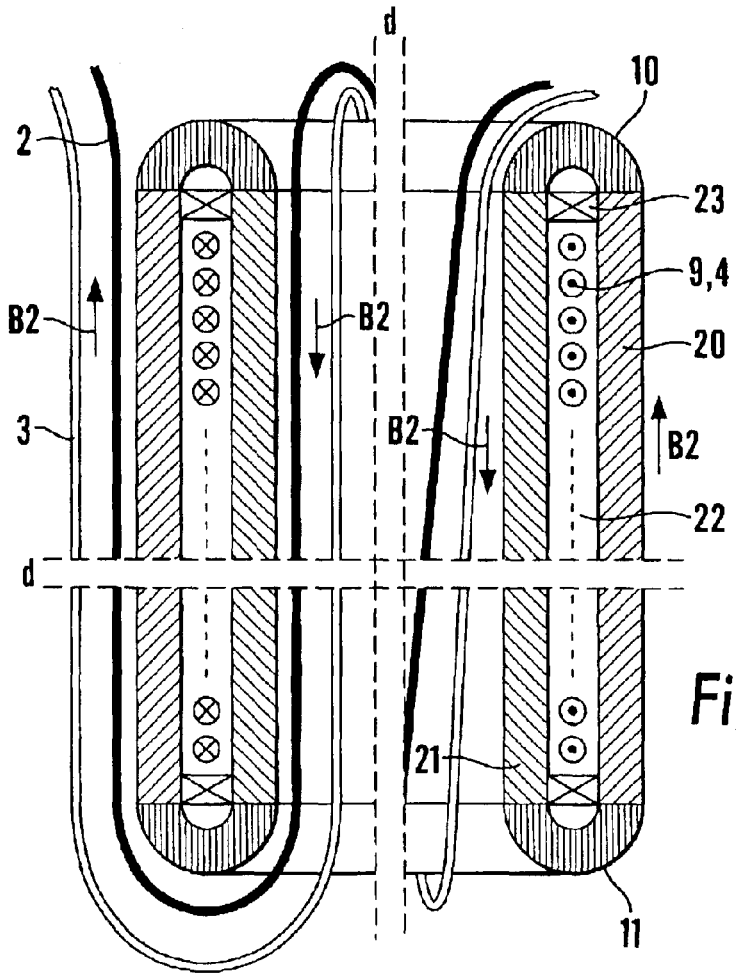
FIGS. 37 and 38 illustrate a third embodiment of the invention.
Figure 37B:
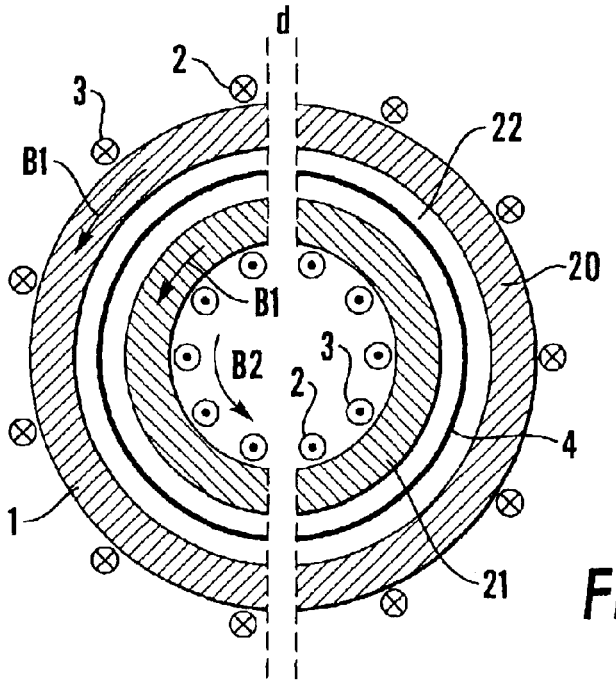
Figure 38A:
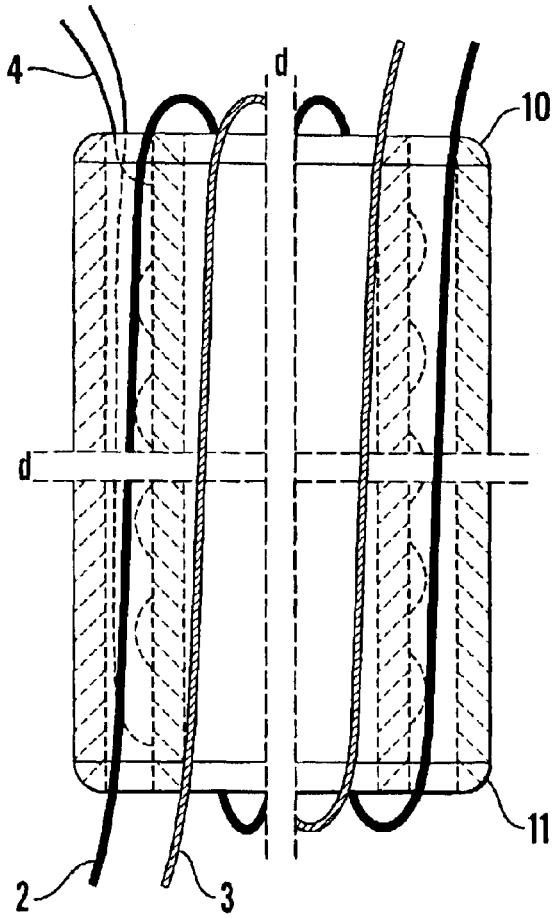
Figure 38B:
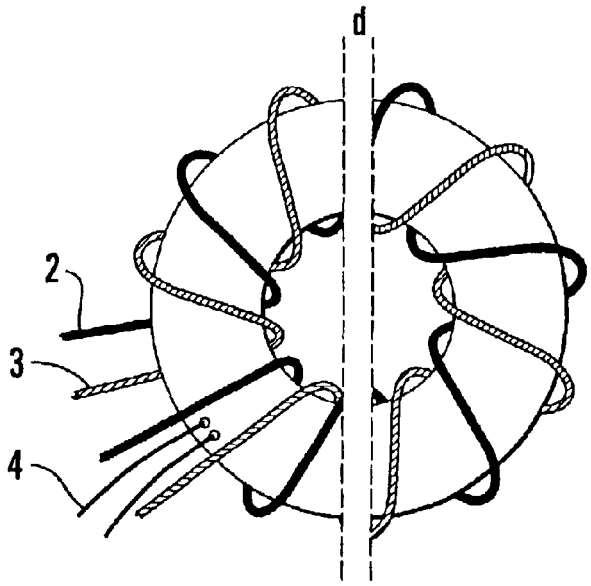

FIGS. 37 and 38 are a sectional illustration and a view respectively illustrating a third embodiment of a magnetically influenced voltage connector device according to the invention. The device comprises (see FIG. 37*b*) a magnetisable body 1 comprising an external tube 20 and an internal tube 21 (or core parts 16, 16') that are concentric and made of a magnetisable material. A gap 22 exists between the external tube's 20 inner wall and the internal tube's 21 outer wall. Magnetic field connectors 10, 11 conducting the tubes 20 and 21 are mounted at respective ends thereof (FIG. 37*a*). A compartment 23 (FIG. 37*a*) is placed in the gap 22 to keep the tubes 20, 21 concentric. A primary winding 4 composed of conductors 9 is wound round the internal tube 21 and is located in the gap 22. The winding axis A2 for the primary winding 4 therefore coincides with the axis A1 of the tubes 20 and 21. An electrical current-carrying or secondary winding 2 composed of the current conductor 8 is passed through the internal tube 21 along the outside of the external tube 20 N1 number of times, where N1=1, . . . r. With the primary winding 4 cooperating with the secondary winding 2 or the current-carrying conductor 8, an easily constructed, but efficient magnetically influenced transformer or switch results. An electrical current-carrying or control winding 3 composed of the current conductor 8' is passed through the internal tube 21 and along the outside of the external tube 20 a quantity of N1 times, where N1=1, . . . , r. This embodiment of the device can also be modified so that the tubes 20, 21 do not have a round cross section but include a cross section that is selected from the group of shapes consisting of square, rectangular, triangular, etc.

It is also possible to wind the primary main winding round the internal tube 21, in which case the axis A2 for the main winding will coincide with the axis A1 of the tubes, and the control and the secondary winding are wound round the tubes on the inside of 21 and the outside of 20.

Figure 39A:
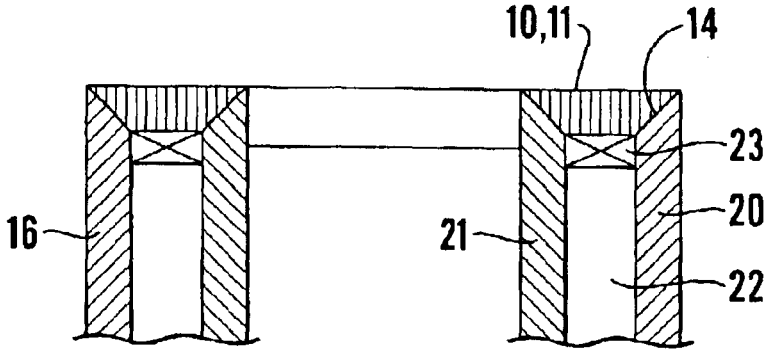
FIGS. 39–41 illustrate special embodiments of magnetic field connectors for use in the third embodiment of the invention.
Figure 39B:
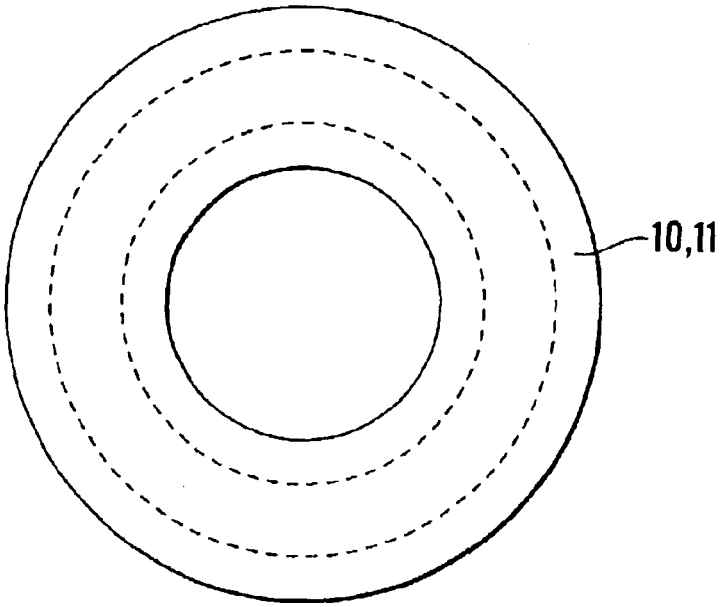
Figure 40:
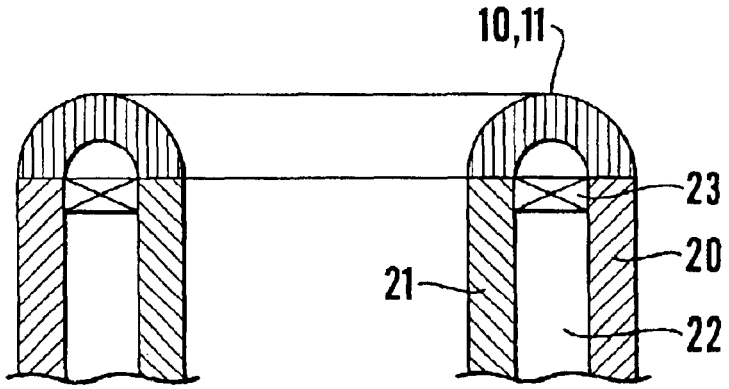
Figure 41:
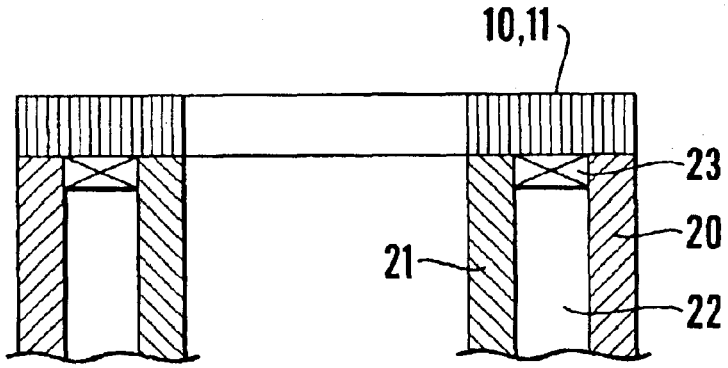

FIGS. 39–41 illustrate different embodiments of the magnetic field connector 10, 11, which are specially adapted for the last-mentioned embodiment of the invention, i.e. that described in connection with FIGS. 37 and 38.

FIG. 39*a* is a sectional view and FIG. 39*b* a view from above of a magnetic field connector 10, 11 with connecting surfaces 14' at an angle relative to the axis of the tubes 20, 21 (the core parts 16) and naturally the internal 21 and external 20 tubes will also be at the same angle to the connecting surfaces 14.

FIGS. 40 and 41 illustrate other variants of the magnetic field connector 10, 11 where the connecting surfaces 14' of the control field H2 (B2) are at right angles to the main axis of the core parts 16 (tubes 20, 21).

FIG. 40 illustrates a hollow semi-toroidal magnetic field connector 10, 11 with a hollow, semicircular cross section, while FIG. 39 illustrates a toroidal magnetic field connector with a rectangular cross section.

Figure 42:
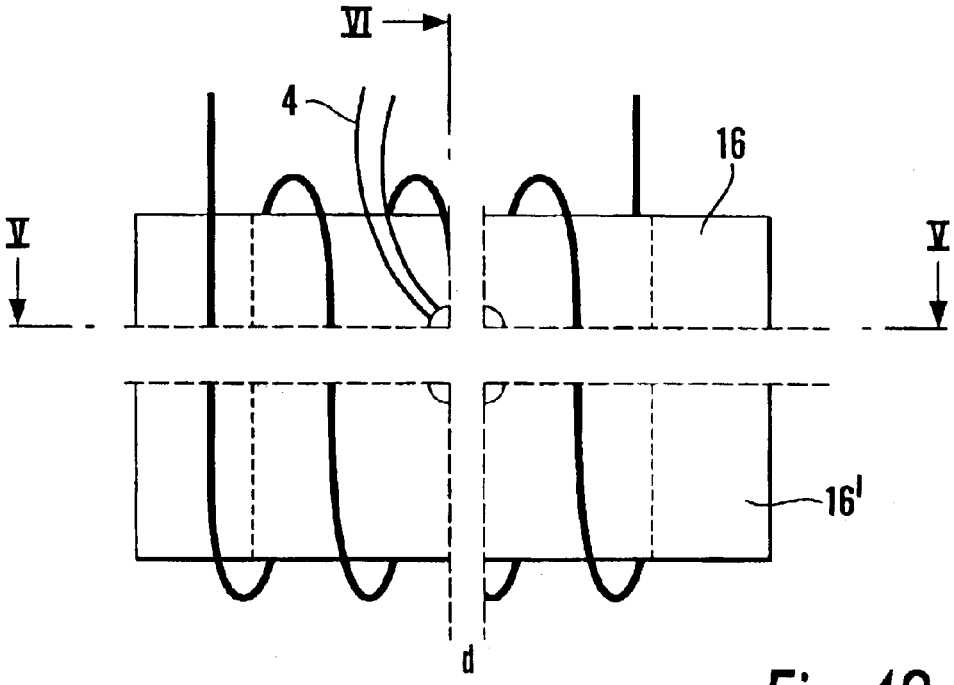
FIG. 42 illustrates the third embodiment of the invention adapted for use as a transformer.

FIG. 42 illustrates the third embodiment of the invention adapted for use as a transformer.

Figure 43:
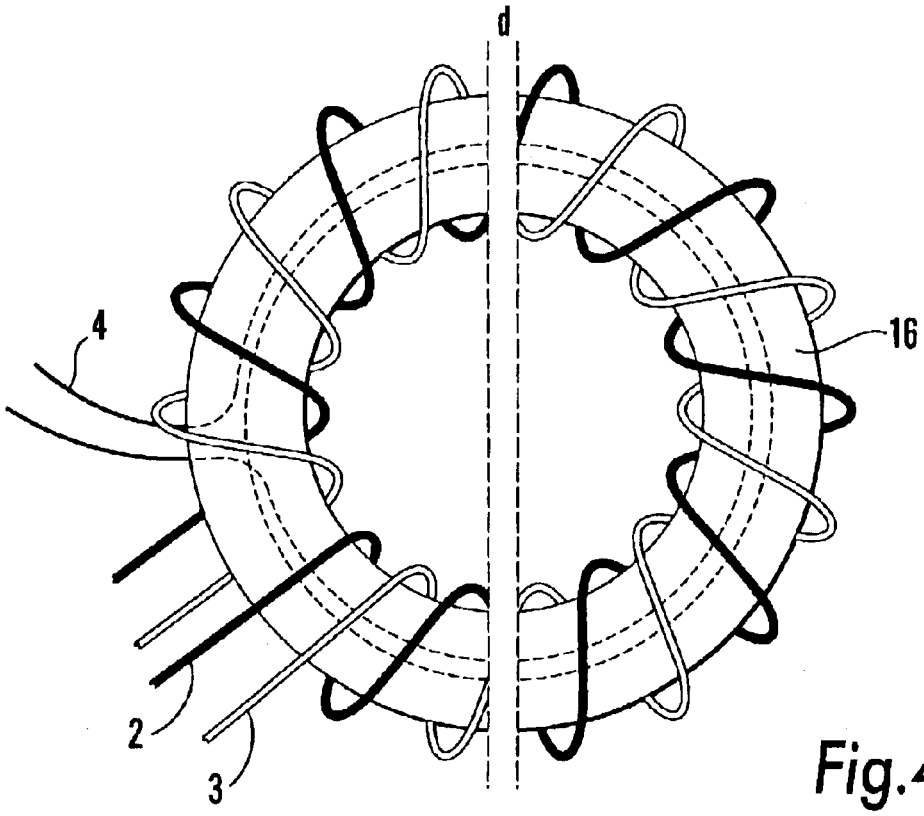
FIGS. 43 and 44 illustrate the fourth embodiment of the invention adapted to a powder-based magnetic material, and thereby without magnetic field connectors.
Figure 44:
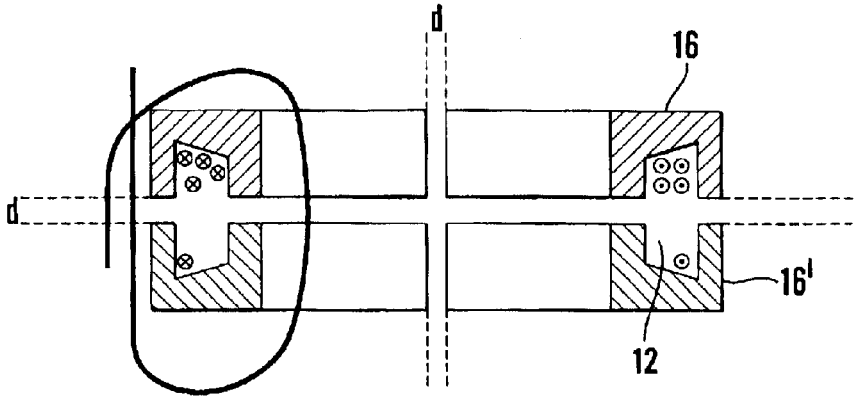
Figure 45A:
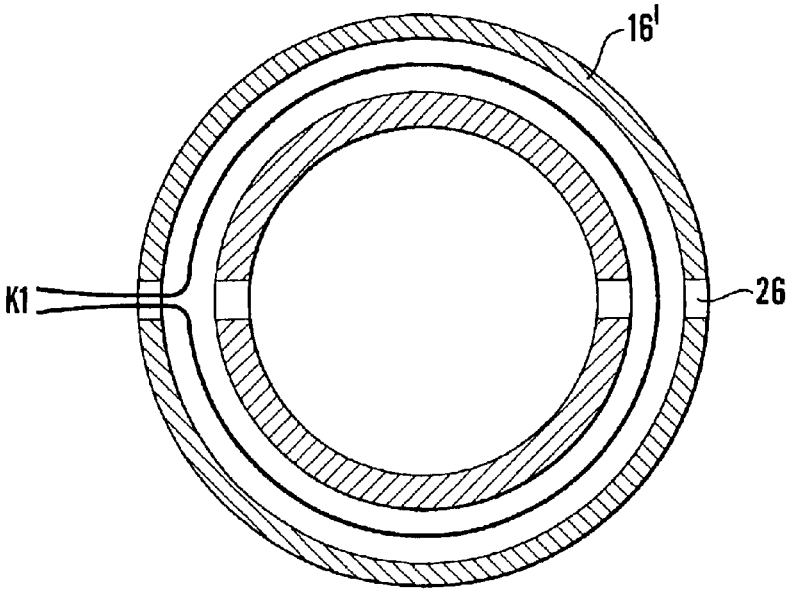
Figure 45B:
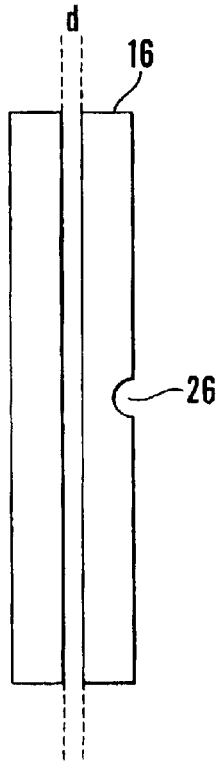
Figure 46A:
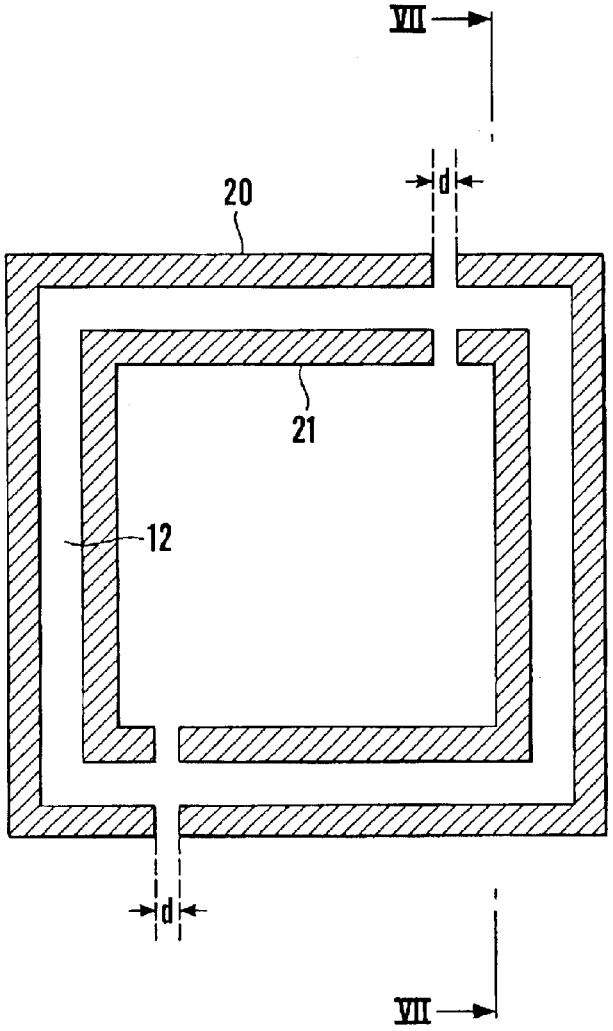
FIGS. 46 and 47 illustrate a core adapted to a powder-based magnetic material, and thereby without magnetic field connectors.
Figure 46B:
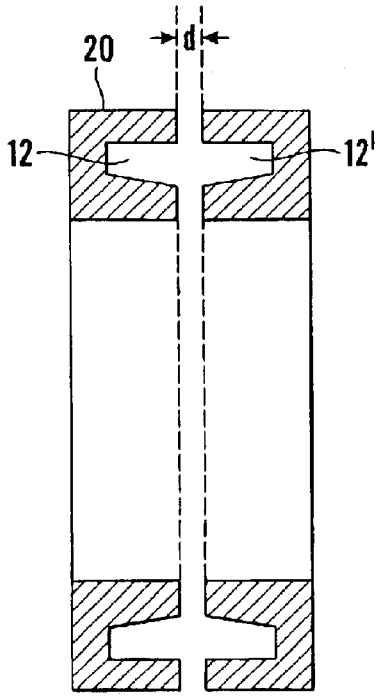
Figure 47A:
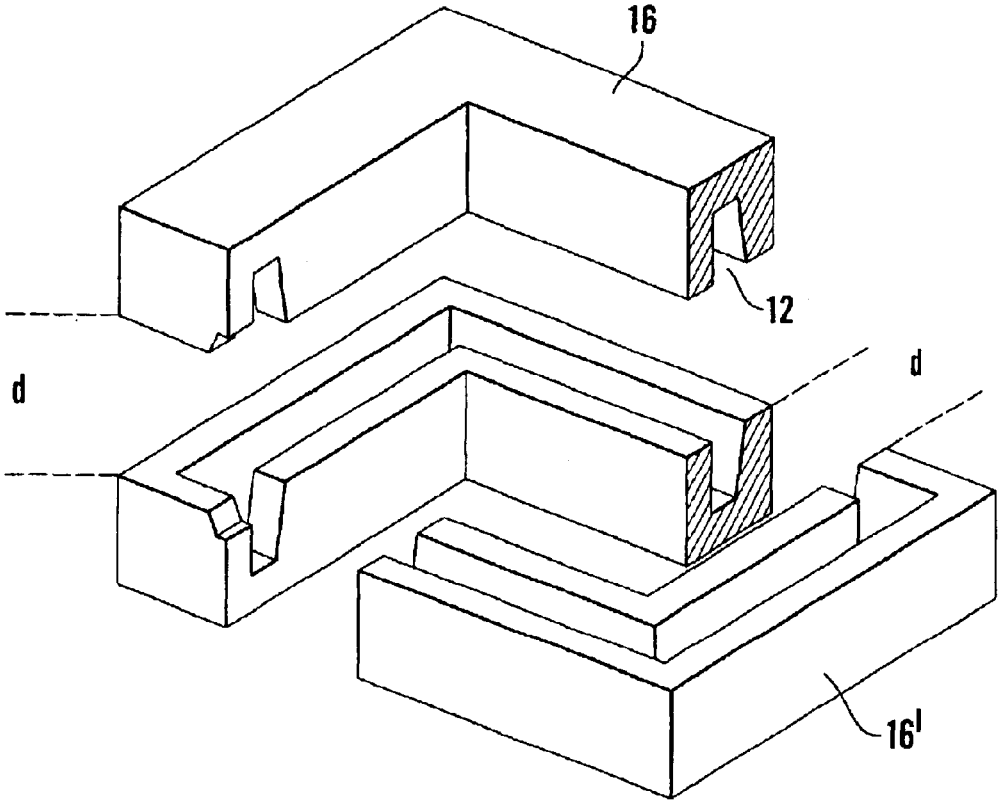
Figure 47B:
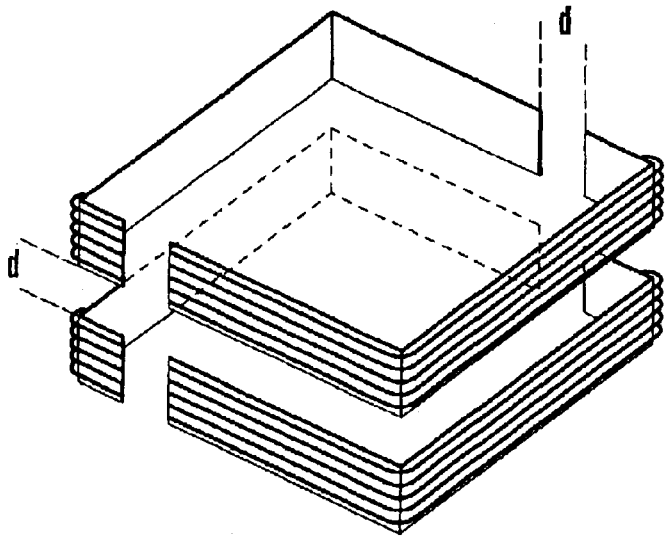

FIGS. 43 and 44 illustrate an embodiment of the invention adapted to a powder-based magnetic material, and thereby without magnetic field connectors. FIGS. 44 and 45 illustrate a section along lines VI—VI and V—V, respectively, in FIG. 42. FIGS. 46 and 47 illustrate a core adapted to a powder-based magnetic material. The core in FIGS. 46 and 47 does not include magnetic field connectors.

Figure 48:
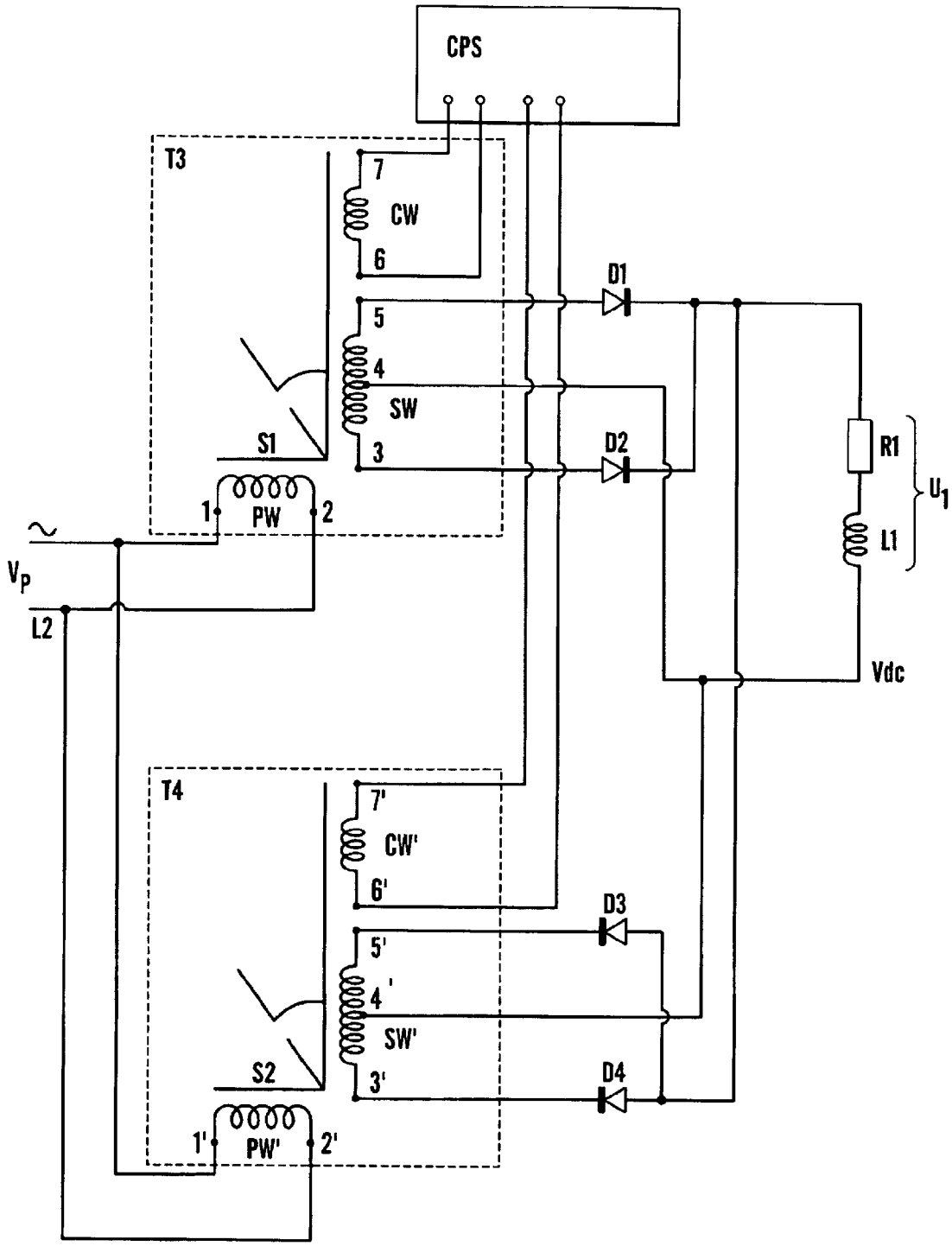
FIG. 48 illustrates a circuit for controlled rectification according to the invention.

FIG. 48 shows a frequency converter according to an embodiment of the invention. The primary winding (PW) of a first transformer (T3) is connected to a controllable power supply (CPS). A central point (4) of the secondary winding (SW) of the first transformer (T3) is connected to a load (motor, R1, L1), which is referred to as U1. The ends of said first secondary winding (5, 3) are connected to a first diode rectifier topology (D1, D2 respectively). An AC voltage is supplied by the controllable power supply (CPS) to the first control winding (CW) in the first transformer (T3). The primary winding (PW') of a second transformer (T4) is connected to the controllable power supply. A central point (4') of the secondary winding (SW') of the second transformer (T4) is connected in parallel with the central point (4) of the first transformer to the load (motor). The ends (5', 3') of the secondary winding (SW') of the second transformer (T4) are connected to a second diode rectifier topology (D3, D4 respectively). An AC voltage is supplied by the controllable power supply (CPS) to the second control winding (CW') of the second transformer (T4). In a version of this embodiment, the frequency converter is used for motor control.

Rectification is achieved by energizing the first control winding (CW) of the first transformer (T3). A transformer effect occurs between the primary winding (PW) and the secondary winding (SW) of the first transformer (T3, SW) when the transformer (T3) is energized. The voltage from the secondary winding (SW) of the first transformer (SW) is rectified by diodes D1 and D2 and the resulting voltage (Vdc) is applied to the load (U1). The primary winding (CPW') of the second transformer (T4) is in off state as the control winding (CW') of the second transformer (T4) is not energized. As a result, a high impedance is provided in the secondary winding (SW') of the second transformer (T4) which is in parallel to the load (U1). During the period in which the first control winding (CW) is energized, a voltage on the primary (PW) of the first transformer (T3) is rectified and appears on the load (U1) as a positive voltage. The control winding (CW) of the first transformer (T3) is then de-energized and, the secondary winding (SW) of the first transformer (T3) is in a state of high impedance at this time. The control winding (CW') of the second transformer (T4) is energized. A transformer effect occurs between the primary (PW') and the secondary windings (SW') of the transformer (T4) at this time. The voltage from the secondary winding (SW') of the second transformer (T4) is rectified by the second diode configuration (D3, D4) and the resulting voltage Vdc applies over the load U1 (T4). During the period in which the control winding (CW') of the second transformer (T4) is activated a voltage on the primary winding (PW') of this transformer (T4) is rectified and appears on the load (U1) as a negative voltage. In one embodiment, a variable frequency control from 0 to 50 Hz can be obtained by controlling the activation of the control windings (CW and CW') to control the length of the negative and the positive rectifier period. In a version of this embodiment, CW and CW' are excited by a DC signal.

Figure 49:
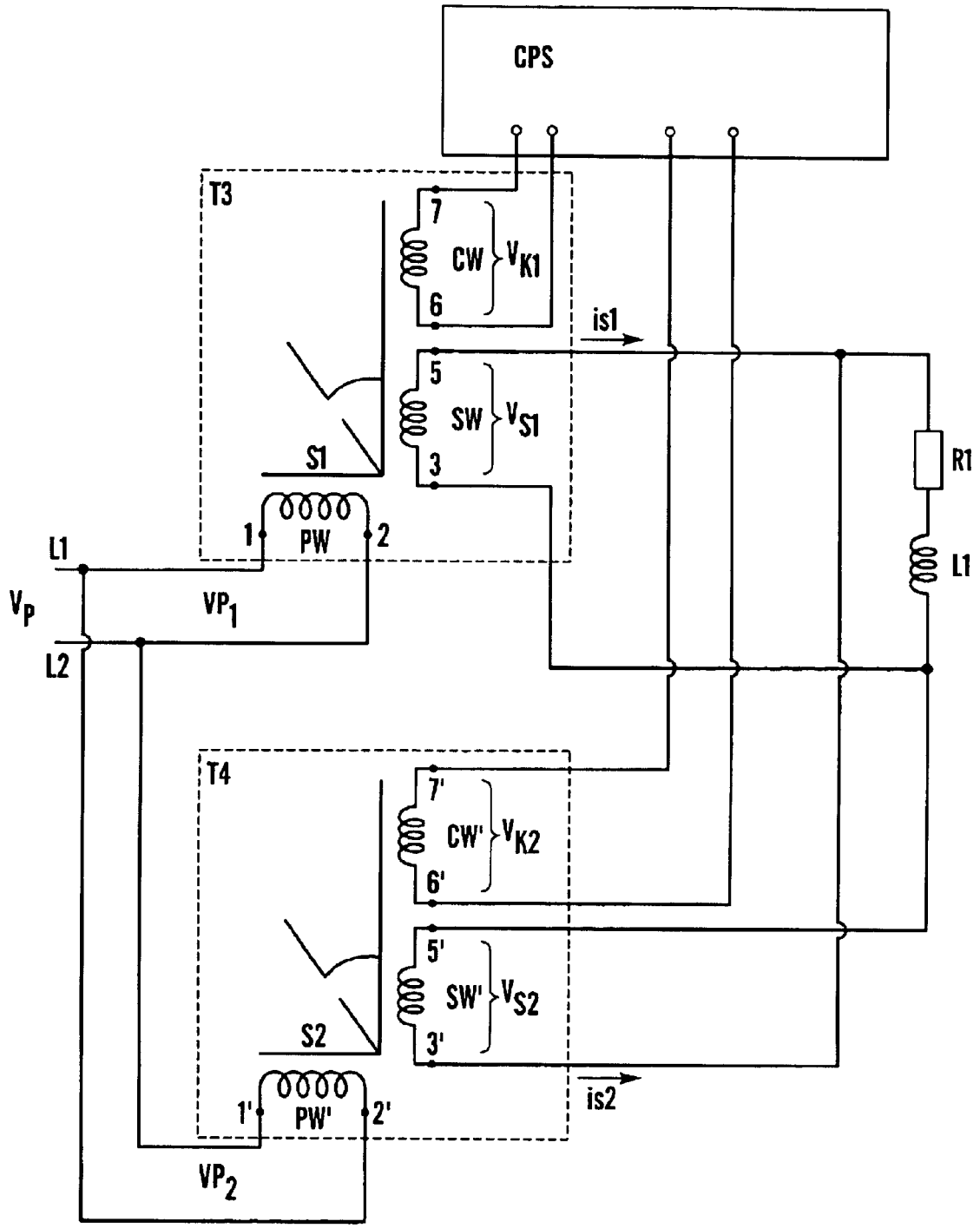
FIG. 49 illustrates an alternative circuit for controlled rectification according to the invention.
Figure 50:
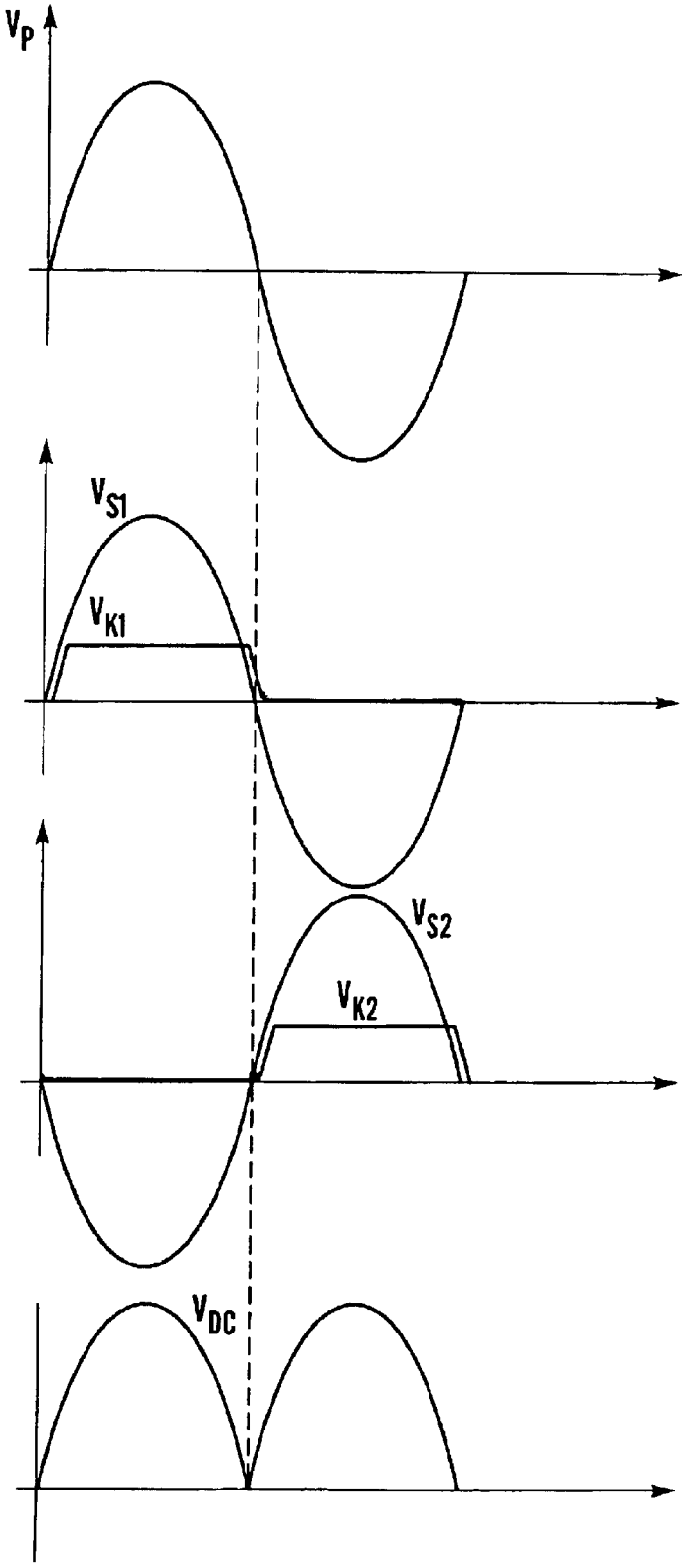
FIG. 50 is a graph of voltage signals of the circuit of FIG. 49.

FIGS. 49 and 50 illustrate another method for rectification by means of a first and a second transformer device according to the invention. The primary winding (PW) of the first transformer (T3) is connected to a controllable power supply (CPS). The secondary winding (SW) of the first transformer (T3) is connected to a load (motor). An AC voltage is supplied by the controllable power supply (CPS) to the control winding (CW) of the first transformer (T3). The primary winding (PW') of a second transformer (T4) is connected to the controllable power supply (CPS). The secondary winding (SW') of the second transformer (T4) is connected in anti-parallel to said load (motor). An AC voltage is supplied by the controllable power supply (CPS) to the second control winding (CW') in the second transformer (T4).

In operation, Vp (represented at the transformer terminals as $VP_1$ and $VP_2$, which is the AC voltage common to the two primaries (PW, PW'), resets the cores S1 and S2 when there is no transformer connection to the secondary side because CW and CW' are deactivated. During the first part of the positive phase of Vp, the control winding (CW) of the first transformer (T3) is activated and transformative connection to the secondary winding (SW) of the first transformer (T3) is obtained, i.e., generating voltage Vs1. Following the zero passage of the negative phase, the control winding of the second transformer (T4) is activated by applying voltage Vk2 to it. The voltage Vs2 is generated voltage on the secondary winding (SW')of the second transformer T4) and connected to the circuit. The rectification is obtained by connecting the primary winding of PW with the terminal 1 connected to L1 and terminal 2 connected to L2. The primary connection to PW' is opposite the connection of PW; terminal 1' is connected to L2 and terminal 2' to L1, where L1 and L2 represent the terminals of an AC power source. The secondary windings (SW and SW') are connected to the load in parallel to one another. At a first time, a pulsed control voltage Vk1 is applied in phase to Vp on PW. As a result, Vs1 is induced and appears on both the load and on SW'. SW' is in high impedance mode and the current from SW is applied to the load. At the next zero crossing of the primary voltage Vp, Vk1 is removed and SW returns to high impedance., Vk2 is applied and again a voltage Vs2 appears on the load and on SW. In an alternative embodiment, Vk1 and Vk2 may be applied in phase and opposite to Vp. In yet another embodiment, Vk1 and Vk2 may be only substantially in phase with Vp.

FIG. 50 is a time versus voltage diagram that shows how the method is implemented by controlling the voltage in the load by means of the voltages in the two control windings. Vk1 and Vk2 are substantially in phase with Vp, but have a small lag compared to Vp.

Variations, modifications, and other implementations of what is described herein will occur to those of ordinary skill in the art without departing from the spirit and scope of the invention as claimed. Accordingly, the invention is to be defined not by the preceding illustrative description but instead by the spirit and scope of the following claims.

What is claimed is:

1. A controllable transformer device comprising;

a body of a magnetic material;

a primary winding wound round the body about a first axis;

a secondary winding wound round the body about a second axis at right angles to the first axis; and a control winding wound around the body about a third axis, coincident with the second axis.

2. The controllable transformer according to claim 1 wherein the body comprises a hollow core with an internal winding compartment and an external winding compartment.

3. The controllable transformer according to claim 2 wherein the primary winding is arranged in the external winding compartment and the secondary winding and the control winding are arranged in the internal winding compartment.

4. The controllable transformer according to claim 2 wherein the primary winding is arranged in the internal winding compartment and the secondary and the control winding are arranged in the external winding compartment.

5. The controllable transformer according to one of the preceding claims, further comprising magnetic field connectors.

6. A method for controllable conversion of a primary alternating electrical signal to a secondary alternating electrical signal using a controllable transformer comprising a body of a magnetic material, a primary winding wound round the body about a first axis, a secondary winding wound round the body about a second axis at right angles to the first axis, and a control winding wound around the body about a third axis, coincident with the second axis, the method comprising the steps of:

supplying the primary winding with the primary alternating electrical signal;

supplying the control winding with an alternating voltage which is shifted in phase relative to the primary alternating electrical signal by one of 0° and 180°; and supplying the control winding with a variable current, wherein a conversion ration of the transformer is controlled by the variable current.

7. A method according to claim 6, wherein the control winding is supplied with a pulsed AC current.

8. A method for controllable conversion of a primary alternating electrical signal to a secondary alternating electrical signal by a controllable transformer comprising a magnetic material having magnetic domains, the method comprising the steps of:

supplying a primary winding with a primary alternating signal;

supplying a control winding with an alternating voltage which is shifted in phase relative to the primary alternating signal by one of 0° and 180°;

adjusting the amplitude of the alternating voltage to change at least one of domain directions in the magnetic material and a magnetization angle between the primary winding and a secondary winding;

introducing an inductance in a control circuit; and adding an electromagnetic force from the secondary winding to an electromagnetic force from the control winding;

whereby a voltage transfer of the transformer is changed, whereby the magnetization angle between the primary winding and the secondary winding is influenced by the added electromagnetic force, whereby an effect of a direct transformative connection between the secondary winding and the control winding is suppressed, whereby a phase angle rotation between the primary winding and the secondary winding varies according to load conditions, whereby the phase angle rotation is compensated for, and whereby a controlled transformation effect is achieved by obtaining a primary winding response to a load change in a secondary load.

9. A method of aligning domains in a magnetisable core of a transformer, the transformer comprising a first winding, a second winding, and a third winding wherein the first winding and the second winding are oriented orthogonal to one another, the method comprising the steps of:

energizing the first winding;

monitoring a current in the first winding;

monitoring a current in the second winding; and exciting the third winding to compensate for domain changes established by the second winding.

10. A method of controlling the orientation of a field in a transformer, the method comprising the steps of:

generating a primary field in a first direction;

generating a secondary field in a second direction orthogonal to the first direction;

generating a control field in a third direction which is coincident to the first direction; and adjusting the control field to control a direction of the primary field.

* * * * *